US011712588B2

(12) United States Patent
Desgroseilliers et al.

(10) Patent No.: US 11,712,588 B2
(45) Date of Patent: Aug. 1, 2023

(54) DOOR BREACHER

(71) Applicant: Off the X Inc., Edmonton International Airport (CA)

(72) Inventors: Ryan Andre Desgroseilliers, Kirkland (CA); Andrew Mackenzie Henry, Montreal (CA); Sergiu Mihai Geamanu, Nitra (SK); Depinder Singh Bhullar, Oshawa (CA); Richard Elliot Fenster, Cote-St-Luc (CA); James Joseph Russell Bracken, Pointe-Claire (CA); Michael Ciccone, Montreal (CA); Ronald Andrew Sutherland, Edmonton (CA)

(73) Assignee: OFF THE X INC., Edmonton International Airport (CA)

( * ) Notice: Subject to any disclaimer, the term of this patent is extended or adjusted under 35 U.S.C. 154(b) by 0 days.

(21) Appl. No.: 17/665,120

(22) Filed: Feb. 4, 2022

(65) Prior Publication Data

US 2022/0152430 A1 May 19, 2022

Related U.S. Application Data

(63) Continuation of application No. 15/446,679, filed on Mar. 1, 2017, now Pat. No. 11,247,078.

(30) Foreign Application Priority Data

Mar. 2, 2016 (CA) ..... CA 2922295

(51) Int. Cl.
*A62B 3/00* (2006.01)
*B25D 9/00* (2006.01)
(Continued)

(52) U.S. Cl.
CPC ..... *A62B 3/005* (2013.01); *B25D 1/00* (2013.01); *B25D 9/00* (2013.01); *F15B 11/08* (2013.01);
(Continued)

(58) Field of Classification Search
CPC .. A62B 3/005; B25D 1/00; B25D 9/00; F15B 11/08; A62D 9/00
(Continued)

(56) References Cited

U.S. PATENT DOCUMENTS 3,081,066 A 3/1963 Murawski
4,443,001 A 4/1984 Haerer
(Continued)

OTHER PUBLICATIONS

Official Action for U.S. Appl. No. 15/446,679, dated Sep. 4, 2019, 15 pages.
(Continued)

*Primary Examiner* — Katina N. Henson
(74) *Attorney, Agent, or Firm* — Sheridan Ross P.C.

(57) ABSTRACT

A door breaching device includes a longitudinal chassis having a first extremity, a piston assembly with a piston rod adapted for linear displacement within a piston chamber, a hydraulic pump operatively connected to the piston assembly, and a two-part head assembly with a fixed jaw attached to the first extremity of the longitudinal chassis and a moveable jaw operatively connected to an end of the piston rod proximate to the first extremity. When the device is in a rest position, the piston rod is in a retracted position within the piston chamber to allow portions of the fixed jaw and the moveable jaw to fit between a first surface and a second surface. Upon actuation of the door breaching device, the piston rod is linearly displaced from the retracted position and the movable jaw applies a force to increase a distance between the first surface and the second surface.

18 Claims, 20 Drawing Sheets

(51) Int. Cl.
*B25D 1/00* (2006.01)
*F15B 11/08* (2006.01)

(52) U.S. Cl.
CPC ..... *B25D 2217/0007* (2013.01); *B25D 2250/095* (2013.01); *F15B 2211/20515* (2013.01); *F15B 2211/7051* (2013.01)

(58) Field of Classification Search
USPC ..... 254/93
See application file for complete search history.

(56) References Cited

U.S. PATENT DOCUMENTS 4,762,304 A * 8/1988 Hill ..... A62B 3/005 72/705
4,783,053 A 11/1988 Yirmiyahu et al.
5,272,811 A 12/1993 Armand
5,329,685 A 7/1994 Gillespie
7,334,775 B2 2/2008 Jacquinot et al.
D595,472 S 6/2009 Kimura
7,926,690 B1 4/2011 Tippmann
8,485,508 B1 * 7/2013 Newman ..... A62B 3/005 254/419
8,909,434 B2 * 12/2014 Anders ..... E02F 9/2095 701/50
11,247,078 B2 2/2022 Desgroseilliers
2013/0320278 A1 12/2013 Hickerson

OTHER PUBLICATIONS

Official Action for U.S. Appl. No. 15/446,679, dated Apr. 30, 2020, 14 pages.
Official Action for U.S. Appl. No. 15/446,679, dated Nov. 24, 2020, 23 pages.
Notice of Allowance for U.S. Appl. No. 15/446,679, dated Sep. 14, 2021, 7 pages.

* cited by examiner

DOOR BREACHER

CROSS-REFERENCE TO RELATED APPLICATIONS

This application is a continuation of U.S. patent application Ser. No. 15/446,679, filed Mar. 1, 2017; which claims the benefit of Canadian Patent Application No. 2,922,295, filed Mar. 2, 2016; the entire disclosures of each of which are hereby incorporated herein by reference in their entireties.

FIELD OF THE INVENTION

The present invention is directed to a device for breaching doors, more specifically it is directed to a device comprising an electro-hydraulic system providing substantial power to the device while being lightweight and portable.

BACKGROUND OF THE INVENTION

Locked and obstructed doors have traditionally been a significant obstacle for emergency responders of all types. Locks of various types have been in use since at least ancient Egypt, predating even the earliest fire brigades by centuries and the introduction of uniformed police services by almost a millennium until fairly recently, the only viable solutions were purely mechanical; either a battering ram, a leverage device such as a pry-bar, or the tedious compromise of the lock itself via locksmith tools.

The simplicity of these tools and their independence from power supply concerns has kept them in use, despite the advancement of force-multiplier technologies such as hydraulics and pneumatics. Modern refinements to manual door-breaching tools have included the development of man-portable battering rams for use by SWAT and military units and the introduction of specialized leverage and wedging tools to fire/rescue units such as the Halligan bar and K-tool. All of these tools are necessarily constrained by their dependence on the manual force of the user, although rotational mechanisms can reduce the force required by sacrificing versatility or speed of operation through the use of leverage.

These devices have been supplemented, at least in the fire/rescue context, by a small number of large, powerful hydraulic wedging and cutting tools (for instance, the Jaws of Life cutting tool). Due to the significant force and pressure requirements they need to operate, however, these tools typically require an external gasoline- or electrically-powered hydraulic pump to operate. This reduces their effectiveness in many common emergency conditions, such as interventions on upper floors of apartment buildings or inside structures without electrical power. Additionally, the substantial weight and volume of the support systems make them ill-suited to many types of responders, since space is at a premium in light emergency vehicles (police patrol cars, ambulances, etc.) and rapid-response teams may consist of only one or two responders.

This leaves many first-line responder teams without a workable solution for any door that cannot be breached in a trivial manner. Manual tools tend to be slow and unwieldy, and may place the responder at risk in certain situations—for instance, a police intervention against an armed suspect. Hydraulic and other powered tools are impractical to transport and, depending on their power source, may not be able to reach the area where they are needed. This situation often forces the first responders to request the deployment of additional support units, such as the fire brigade or a police tactical team, which can result in victim-endangering delays and increased costs for manpower and equipment.

U.S. Pat. No. 4,762,304 discloses a door opener consisting of two hydraulic actuators which are adapted to act along in two different directions in a horizontal plane, one of said directions being parallel or substantially parallel to the surface of the closed and locked door which is to be opened and the other direction being normal to said door surface. Jamb-engaging elements are associated with a first of the actuators, operation of said actuator causing the elements to engage the door jambs very firmly; operation of the second of the actuators pushes the closed/locked door inwardly out of the door frame.

U.S. Pat. No. 3,081,066 discloses a combined hydraulic elevating and prying apparatus comprising a base member, an upright sleeve mounted on said base member, a ram cylinder mounted in a reciprocal manner within said upright sleeve, a sleeve freely fitted about said upright sleeve for reciprocating movements simultaneously with said ram cylinder, ball bearing members interposed between said upright sleeve and said freely fitted sleeve, said base member having a pair of spaced parallel jaw members forming a lateral extension of said base member, a jaw member carried by said freely fitted sleeve and normally occupying a position between said spaced jaw members, an hydraulic unit having a flexible hose connected to a fluid inlet formed in said base member for discharge of fluid beneath said ram cylinder, a threaded stud on said base member and said hydraulic unit having a swivel action and detachably connected to said threaded stud.

U.S. Pat. No. 4,443,001 discloses a hand tool, for use with a hydraulic pump, for forcing or prying open doors and other objects. First and second jaw members, each having spaced apart fingers, are connected together by a hydraulic piston-cylinder assembly which is adapted for hydraulic connection to the hydraulic pump. The spaced apart fingers of the jaw members mesh with each other when the jaw members are positioned together. A plate member defining opposed sides is connected to the first jaw member and the second jaw member defines first and second guide members with each of the guide members projecting adjacent respective sides of the plate member and in slidable relationship with the plate member. A third guide member extends from the plate member and encircles a portion of the piston-cylinder assembly in slidable relationship with the assembly. This device is operated using a hand-held pump and comes in two parts: the piston rod portion and the pump portion connected together with a rubber tubing to transfer the hydraulic fluid from the hand pump to the piston rod.

A select few rescue devices have, to date, been proposed or implemented using an integrated electro-hydraulic system. Devices do exist that use conventional hydraulic systems; however, these do not provide the user with the compact form factor and light weight that an electric-hydraulic actuator (EHA) based would allow. Moreover, both of these features have been repeatedly stressed by domain experts in law enforcement and emergency response to be of importance in a rescue tool, as these factors significantly affect both the tool's versatility and its potential for general user acceptance.

Most known devices rely on manual pumping or cranking by the user, while those that make use of electrical power generally incorporate external, bulky and, inconvenient battery packs, or require the presence of a full generating apparatus such as a motor vehicle alternator or an electrical mains outlet. The present invention intends on overcoming several drawbacks from known devices as well as provides more versatility in its use.

SUMMARY OF THE INVENTION

The present invention is designed to be operable against both inward and outward-opening doors. Most known powered devices are typically incapable of dealing with both scenarios in the same device package. In the few cases where the design of known devices would hypothetically allow such operation, it is generally not promoted or supported by the manufacturer.

According to a first aspect of the present invention, there is provided a door breaching device comprising:

a longitudinal chassis having a first and a second extremity;

a piston assembly located at said first extremity of the chassis, said piston assembly comprising a piston rod, said piston rod having, at a first end, a head and a second end located inside a piston chamber, said piston chamber having two opposite ends, a first end having an opening adapted for the movement of the piston rod therethrough and a second end located opposite said first end; wherein said piston rod is adapted for linear displacement between a first position where the second end of the piston rod is positioned at the second end of the piston chamber and a second position where the second end of the piston rod is at the first end of the piston chamber;

a motor operatively connected to a hydraulic pump which is operatively connected to the piston chamber;

a control unit for user input, said control unit being operatively connected to the motor;

a two-part head assembly comprising:

a fixed jaw, attached to the first extremity of the chassis; and a movable jaw, operatively connected to the piston rod of the piston assembly;

wherein, in the rest position, the piston rod is in a retracted position to allow the fixed jaw and the movable jaw form a L-shaped extension from the chassis, and upon actuation, the piston rod moves outwardly from the retracted position, the fixed jaw braces the device against an element of a door and frame assembly, while the movable jaw applies a linear force to an opposite element of the door and frame assembly thereby having the movable jaw and fixed jaw form a F-shaped extension from the chassis.

Preferably, the movable jaw has two extremities: a first extremity having a tapered end and adapted for insertion into objects to be breached and a second extremity opposite said first extremity.

According to a preferred embodiment, the door breaching device further comprises at least one guide rod substantially parallel to the piston and along which the movable jaw is displaced upon actuation of actuator. Preferably, the at least one guide rod is secured proximate the second extremity of said movable jaw and the piston rod is secured proximate the first extremity of said movable jaw.

According to a preferred embodiment, the door breaching device further comprises an electronic regulation subsystem operatively connected to the control unit. Also preferably, the door breaching device further comprises a power dense electrical storage device operatively connected to the motor and the control unit.

According to a preferred embodiment, the door breaching device further comprises wireless reception and transmission means operatively connected to the control unit.

Preferably, the door breaching device may further comprise a primary state control subsystem adapted to interpret an operator's input and a current state of the device in order to assist the user in determining the correct mode of operation for the device and the appropriate motor movement status.

According to a second aspect of the present invention, there is provided a door breaching device adapted to provide a user with two ways of breaching a door, said device comprising:

a longitudinal chassis having a first and a second extremity;

a piston assembly located at said first extremity of the chassis, said piston assembly comprising a piston rod, said piston rod having, at a first end, a head and a second end located inside a piston chamber, said piston chamber having two opposite ends, a first end having an opening adapted for the movement of the piston rod therethrough and a second end located opposite said first end; wherein said piston rod is adapted for linear displacement between a first position where the second end of the piston rod is positioned at the second end of the piston chamber and a second position where the second end of the piston rod is at the first end of the piston chamber;

a motor operatively connected to a hydraulic pump which is operatively connected to the piston chamber;

a control unit for user input, said control unit being operatively connected to the motor;

a two-part head assembly comprising:

a fixed jaw, attached to the first extremity of the chassis; and a movable jaw, operatively connected to the piston rod of the piston assembly;

at least one guide rod having a first and a second opposite ends, said guide rod positioned parallel to the piston rod, said guide rod having a first end attached to the movable jaw and a second end slidably engaged with the chassis;

wherein, in the rest position, the piston rod is in a retracted position to allow the fixed jaw and the movable jaw form a L-shaped extension from the chassis, and upon actuation, the piston rod moves outwardly from the rest position, the fixed jaw braces the device against an element of a door and frame assembly, while the movable jaw applies a linear force to an opposite element of the door and frame assembly thereby having the movable jaw and fixed jaw form a F-shaped extension from the chassis.

wherein the device can alternatively be used as a battering ram by said user.

Preferably, the door breaching device further comprises at least one handle located on a longitudinal side of the device and adapted to allow said user to use the device as a battering ram.

Also preferably, the door breaching device can further comprise a second handle located away from the at least one handle and adapted to allow said user to use the device as a battering ram. Preferably, the second handle is located on the second extremity of the chassis.

According to another preferred embodiment of the present invention, the second handle is located on the longitudinal chassis parallel to the at least one handle.

According to another preferred embodiment of the present invention, the second handle is located on the longitudinal chassis on a side opposite that where the at least one handle is located.

According to a preferred embodiment of the present invention, the striking head of the battering ram consists of the first extremity.

According to another preferred embodiment of the present invention, the striking head of the battering ram consists of the second extremity.

Preferably, the movable jaw has two extremities: a first extremity comprising at least one tapered face and adapted for insertion into objects to be breached and a second extremity opposite said first extremity.

In a preferred embodiment, the guide rod set is secured to allow balancing out the stress placed on the first extremity of the jaw while at the same time allow the piston rod to be placed closer to the tapered end of the jaw and thus exert more force at the breach point. According to another preferred embodiment, the guide rod set aids in preventing rotation of the movable jaw.

Preferably, the door breaching device further comprises at least one guide rod set substantially parallel to the piston and along which the movable jaw is displaced upon actuation of the actuator.

According to a preferred embodiment of the present invention, the door breaching device further comprises a primary state control subsystem adapted to interpret an operator's input. Optionally, the device may also highlight to the user the current state of the device in order to assist the user in determining the correct mode of operation for the device and, also possibly, the appropriate hydraulic pump motor movement status. This can be seen as the primary user interface.

According to a preferred embodiment of the present invention, there is provided a device which uses a motor with a linear hydraulic pump operatively connected to a piston likely capable of delivering force in the magnitude of thousands of pounds to breach a door (well above the expected force required to compromise a steel door). A specialized high-power battery or equivalent integrated power source can be used in order to deliver the power required for the device to operate correctly under the expected mechanical load.

Preferably, the present invention preferably uses a hydraulic pump motor and an electrical regulation subsystem. An electrical regulation subsystem will be used in order to regulate certain electrical parameters of the hydraulic pump motor and ensure that the electric characteristics remain within the manufacturer's specifications, even if these parameters do not correspond to those normally provided by the power storage component or the device is in a transition state. Additionally, the electrical regulation subsystem can identify potential overload or other failure states and perform a transition to a fail-safe condition as necessary to prevent serious malfunction or damage to the unit, and transmit any failure detection to the primary state control subsystem.

Preferably the device further comprises at least one handle located on a longitudinal side of the device and adapted to allow said user to use the device as a battering ram. More preferably, the device further comprises a second handle located away from the at least one handle and adapted to allow said user to use the device as a battering ram. Even more preferably, the second handle is located on the extremity of the device opposite that of the striking head of the battering ram. According to a preferred embodiment, the striking head of the battering ram consists of the first extremity of the chassis. According to another preferred embodiment, the striking head is located at the second extremity of the chassis.

Preferably, the portable battering ram door breaching device comprises two handles adapted to swing said door breacher as a battering ram. According to a preferred embodiment, the two handles can be positioned parallel to the longitudinal chassis.

According to another aspect of the present invention, there is provided a door breacher adapted for use as a conventional battering ram and as a hydraulic powered door breaching device. This gives the user the ability to choose the manual way of breaching a door or, when encountering more resilient doors, he can choose to do so by using hydraulic power of the door breacher of the present invention.

BRIEF DESCRIPTION OF THE FIGURES

The invention may be more completely understood in consideration of the following description of various embodiments of the invention in connection with the accompanying figures, in which.

DESCRIPTION OF PREFERRED EMBODIMENTS OF THE INVENTION

Figure 1:
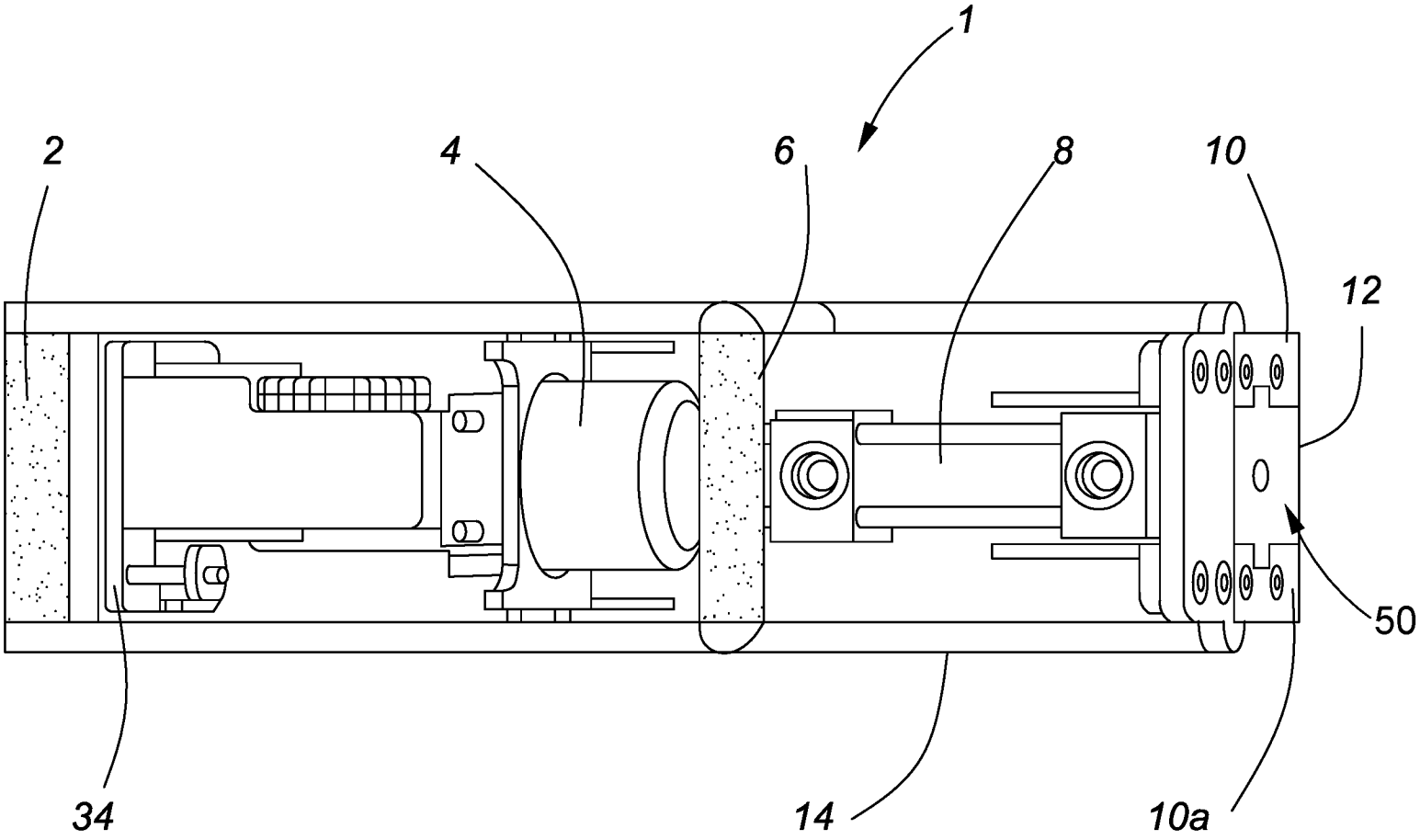
FIG. 1 is a top view of a door breacher according to a preferred embodiment of the present invention.

According to a preferred embodiment of the present invention, the door breacher can be actuated from the rest position to a first position where the movable jaw moves against either the door or the frame (depending on its placement) and braces itself without breaching the door but sufficiently enough to hold the door breacher in place with no help from the operator. This is referred to actuation without breaching, or actuation to a first position. Once braced against the door and door frame assembly, the user can then actuate the pump by remote activation to breach the door while being in a safe location if the user fears threats such as gunfire or explosion upon door breaching.

A preferred embodiment of the present invention preferably uses a primary state control subsystem. The actuator control and electrical regulation subsystem are controlled by the primary state control subsystem, which will interpret the operator's input and the current state of the device in order to determine the correct mode of operation for the device and the appropriate hydraulic pump motor movement status. Preferably, the control subsystem panel can comprise a few pushbuttons and an on/off switch for manual actuation of the device. It then transmits the operating instructions to the electrical regulation subsystem, as well as transmitting a status indication feedback signal to a control panel subsystem in order for the control panel to display an accurate visual status indicator to the user. The primary state control subsystem receives electrical and potentially mechanical feedback from other subsystems via sensors and transducers in order to detect the current status of the device. According to a preferred embodiment, the panel includes a battery level indicator which will be "solid" when the battery level is good and "blink" when the battery is almost dead.

The present invention preferably uses a control panel subsystem. The control panel subsystem is a physically separate assembly and is intended to translate direct user input, such as button presses, switch toggles, and other manipulations of physical interface elements into electrical signals, which will then be communicated to the primary state control system. It will also operate visual indicator elements to inform the user of the current device state. Communication between the control panel subsystem and the primary state control subsystem can, at the user's option, take place either via a direct wired connection and/or via a pair of radio-frequency digital wireless transceivers.

Preferably, wireless transmissions will be protected against both random error (due to noise, interference, etc.) and falsified third-party signals. This will be achieved by employing both error detection and correction methods and/or encryption of data sent over the wireless link.

Mechanical Operation

According to a preferred embodiment of the present invention, an electrical regulation subsystem will actuate the hydraulic pump motor, which will convert the stored electrical energy into linear mechanical force. This force is to be manipulated by the mechanical subsystem in order to produce a shearing or pushing force, which can then be delivered to the mechanical load (i.e. the door, doorjamb, frame, or other fixture which must be deformed to breach the door).

According to a preferred embodiment of the present invention, the device will achieve the successful breaching of the door via the application of a shearing or pushing force (as determined by the device's position relative to the door). In order to achieve this, it utilizes a two-part, F-shaped head assembly comprising a fixed jaw, attached to the chassis of the device, and a movable jaw, operatively connected to the piston rod of the actuator. In the default position, these two jaws form a single L-shaped extension from the device chassis, and can be positioned in several orientations in order to target different components of the targeted door-and-frame fixture. Upon actuation, as the piston rod extends from its default position, the fixed jaw will brace the device against one element of the door and/or frame fixture, while the movable jaw will apply the actuator's linear force to the opposite part of the of the door and/or frame assembly. The application by the actuator of a mechanical force would, either via opposing push forces or shearing, cause the opposing jaws to cause deformations to the door and/or frame assembly, with the net result being the loss of the fixture's structural integrity and/or opening of the door.

According to a preferred embodiment of the present invention, the device can be positioned, but not limited to: (a) between the door and the doorjamb, for an inward-opening door, such that the movable jaw would push against the door and the fixed jaw would rest against the doorjamb. This would result in considerable stress being placed on the locking mechanism, deadbolt(s), doorknob mechanism, doorjamb itself and/or the hinges; (b) between the door and the side of the door frame on the lock side or hinges, for an outward-opening door, such that the movable jaw would push against the door frame and the fixed jaw would rest against the door. This would result in a significant bending moment being generated against both the door and frame; (c) under the door, such that the movable jaw would push against the floor and the fixed jaw would rest against the door. This would result in a significant bending moment being generated against the door, This type of usage might require additional intervention by the operator to fully compromise the door, depending on the door configuration; (d) between the door and the top of the door frame, in a manner similar to under the door, with the added possibility of deformation of the door frame; and (e) between the door and the side of the door frame on the hinge side, for an inward or an outward-opening door, such that the movable jaw would push against the door frame and the fixed jaw would rest against the door. This would result in considerable stress being placed on the door's hinges as well as the door frame.

The following is a list of functional characteristics of the door breaching tool according to a preferred embodiment of the present invention.

Preferred Functional Characteristics—Breaching Targets

Preferably, the device must be capable of breaching doors that would typically be found in commercial or residential buildings. A steel fire door with steel frame, deadbolt lock, and high-strength hinges can be considered as the most difficult potential target for a door breaching tool according to the present invention. According to a preferred embodiment, the device can function reliably against both inward- and outward-opening doors. According to another preferred embodiment, the door breacher can open magnetically locked doors, pry tour bus doors and car doors.

Autonomy

Preferably, the device must be operable by a single individual without the presence of additional support personnel or vehicles. The device's primary power source should preferably be stored within the physical structure of the device and the device must not require any additional equipment such as an external pump, battery, charger, or other apparatus for operation, although these may be required for preparation or maintenance between periods of use.

Preferably, the device is to be remotely controlled in order to minimize the risk of injury to the operator as a result of hazards present during deployment, such as armed criminal suspects or fire flashover. By including remotely controlled operation, this danger can be alleviated. According to a preferred embodiment, the door breacher does not require the operator to maintain the placement of the device during operation.

Preferably, the chassis is designed such that in case of electrical failures, the device may be used as a battering ram preferably when the movable jaw is in the rest position (i.e. retracted).

Ideally, the device must adhere to all applicable laws and regulations regarding radio frequency interference and must operate in a suitably licensed (or unregulated) frequency band of for any radio communications performed. It must also operate safely even in the presence of interference or noise, even if such interference or noise prevents meaningful wireless communication, in which case it should return to a safe state and allow the user to take corrective action.

Preferred Non-Functional Characteristics

The following is a list of non-functional characteristics of the door breaching tool according to a preferred embodiment of the present invention. Weight is extremely important in order to allow for the greatest possible number of users and uses for portable applications. Preferably, the device must operate so that a single operator can easily carry it a reasonable distance under stressful conditions without exhausting themselves. Ideally, the device is preferably small enough to be stored in an emergency response vehicle.

Preferably also, the device must be able to withstand shocks caused by dropping or physical impact since its primary intended use is to be in emergency situations. The device's reliability is also of great importance since lives may be at stake. The rate of failure of components must be at an absolute minimum in most environmental conditions even after heavy wear and tear.

Upon proper use, the device will not pose a significant risk of injury to the operator or others in its vicinity. According to a preferred embodiment, extensive safety training should not be required to use the device correctly and despite the possibility that a large electric current may flow through the device, it will minimize the risk of explosion, overheating or catching fire under normal operating conditions. If operated beyond its capacity, the device is designed to preferably fail safely to maintain the operator's safety.

Referring now to FIGS. 1 to 6, there is shown various preferred embodiments of a door breaching device according to the present invention are shown.

FIG. 1 shows the door breacher (1) from above with the external panels removed to see the internal components thereof. Starting from the left end, a first handle (2), followed by the main control unit (34) and then the pump (4), the second handle (6), the guide rod (8) and the two-part jaw member (10, 10*a* and 12), which forms the striking head (50) on the right end. The door breacher comprises a strengthening brace made up of two longitudinal rods (14) running from the back of the door breacher all the way to the front and terminating at the fixed part of the jaws (10 and 10*a*). The front part of the door breacher is determined by the location of the teeth of the first and second jaw members (10, 10*a* and 12) as it those teeth that are inserted in the space between a door and a door frame.

Figure 2:
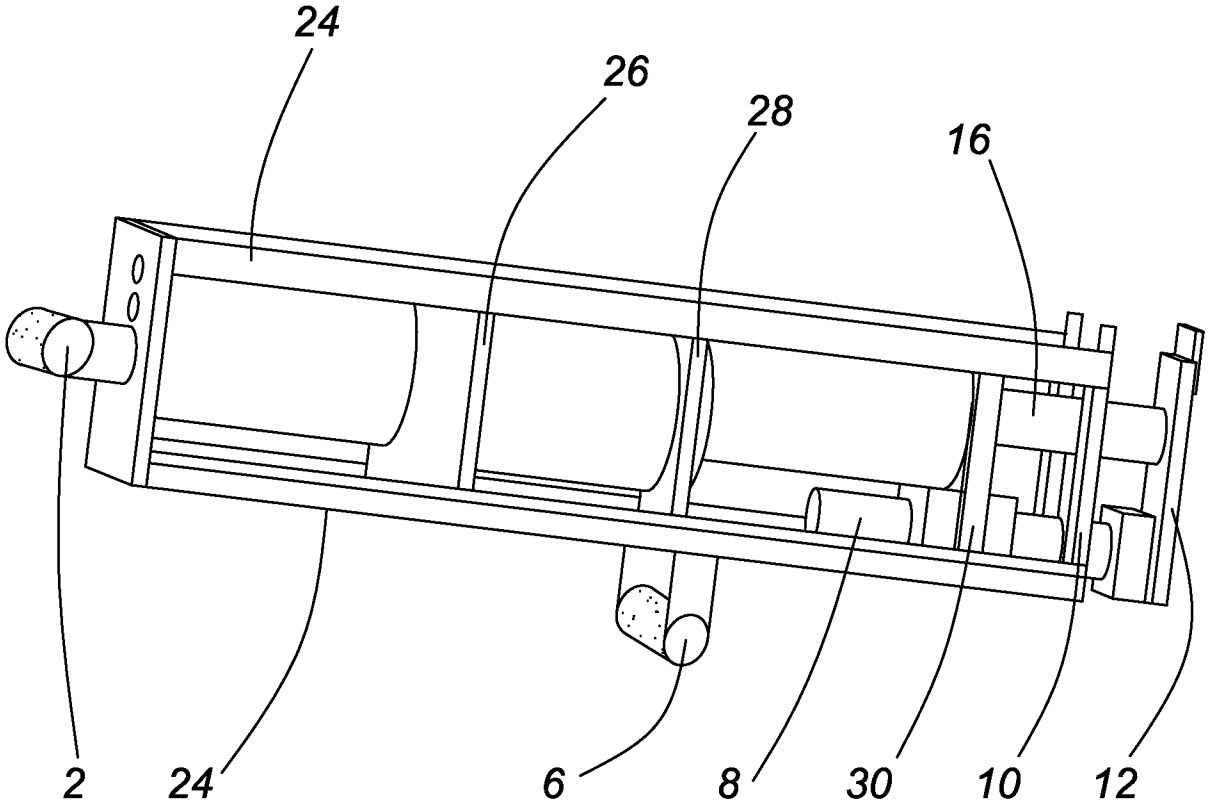
FIG. 2 is a side view of the door breacher according to a preferred embodiment of the present invention.

FIG. 2 is a perspective side view of the door breacher according to a preferred embodiment of the present invention, showing the extension of piston rod (16) moving the movable jaw member (12) outwardly away from the fixed part of the jaw (10 and 10*a*). The frame of the door breacher is constructed of four members (24) running longitudinally from the front of the device (where the jaw is located) to the back (where the first handle is located). The pump (4) is secured to the frame by two framing members (26 and 28) which are perpendicular to the four longitudinal frame members (24). The guide rod (8) is similarly secured to at least two of the longitudinal frame members (24) in a similar fashion, that is either by welds or by attachments means.

Figure 3:
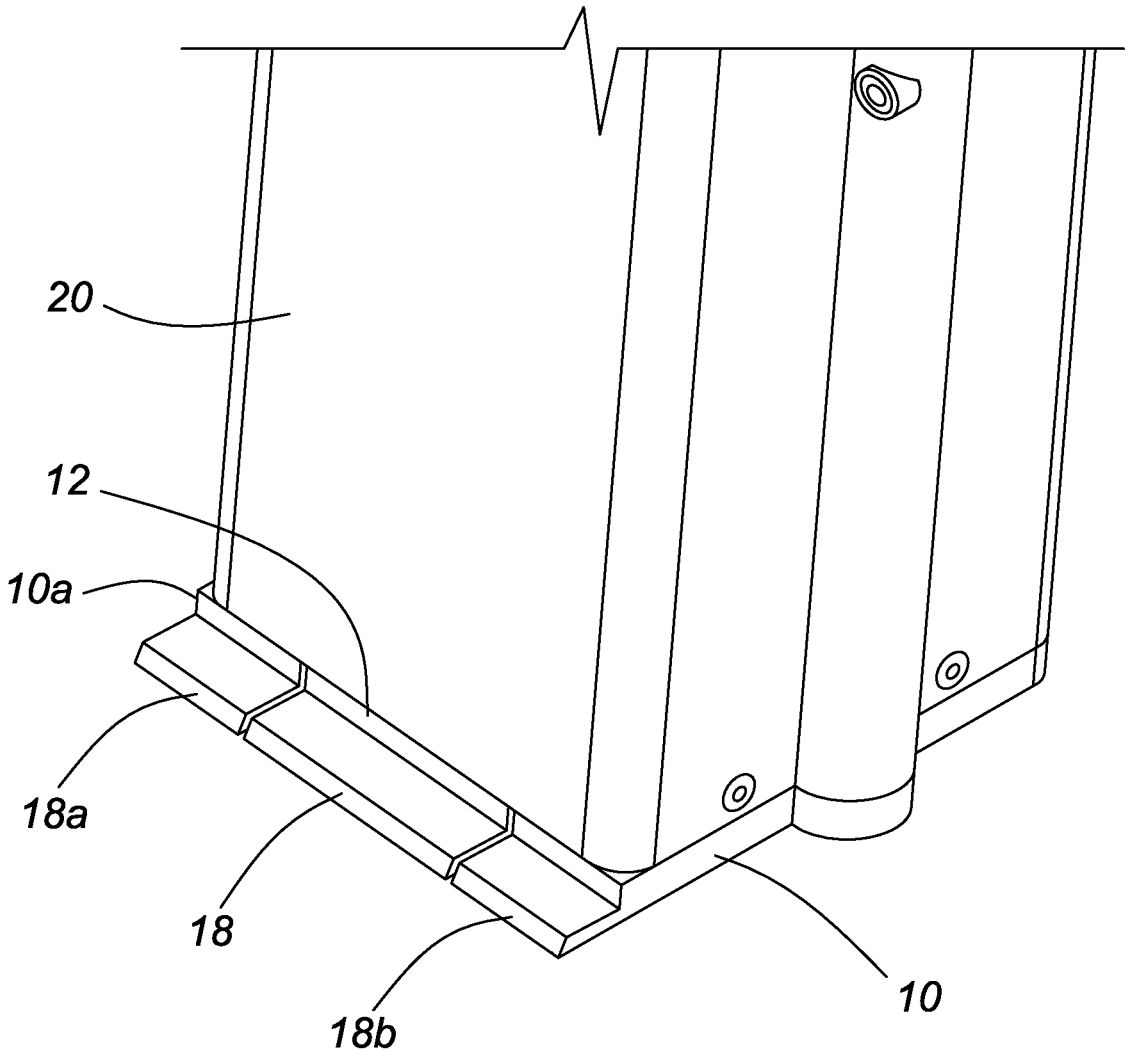
FIG. 3 is a close up perspective view of the jaw member in the retracted position of a door breacher according to a preferred embodiment of the present invention.

FIG. 3 is a close up of the jaw member (10, 10*a* and 12) showing the multi-tapered edge of the teeth (18, 18*a* and 18*b*) to allow easier insertion in the space between a door and a door frame. The jaws of the door breacher are in position to be inserted into a door frame.

Figure 4:
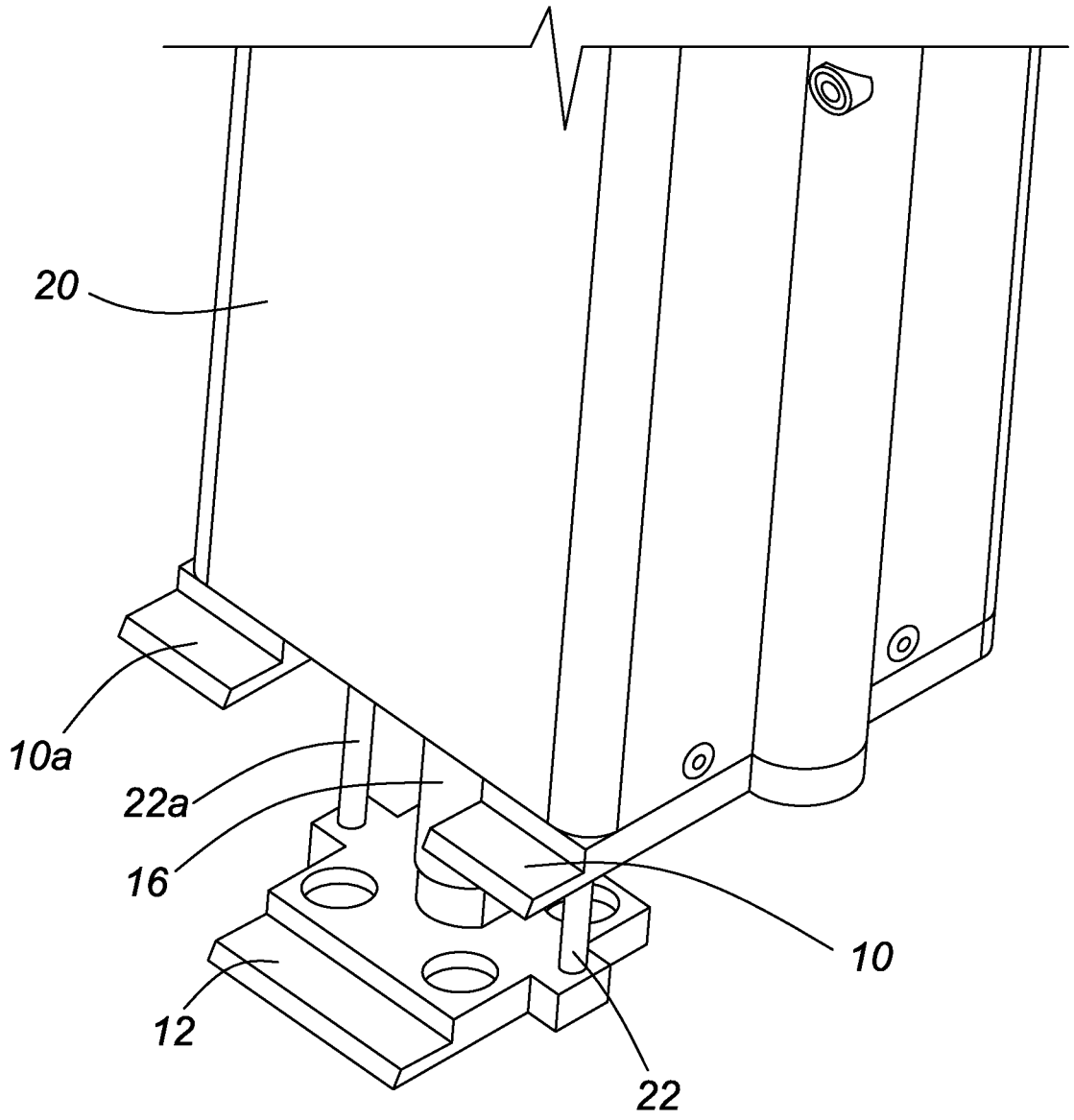
FIG. 4 is a close up perspective view of the jaw member in an extended position of a door breacher according to a preferred embodiment of the present invention.

FIG. 4 is a close up of the front of the device more specifically focusing on the jaw member (10, 10*a* and 12) showing the jaws of the door breacher in an open position after the piston rod (16) was actuated to move the movable jaw (12) outwardly away from the fixed jaws (10 and 10*a*).

Figure 5:
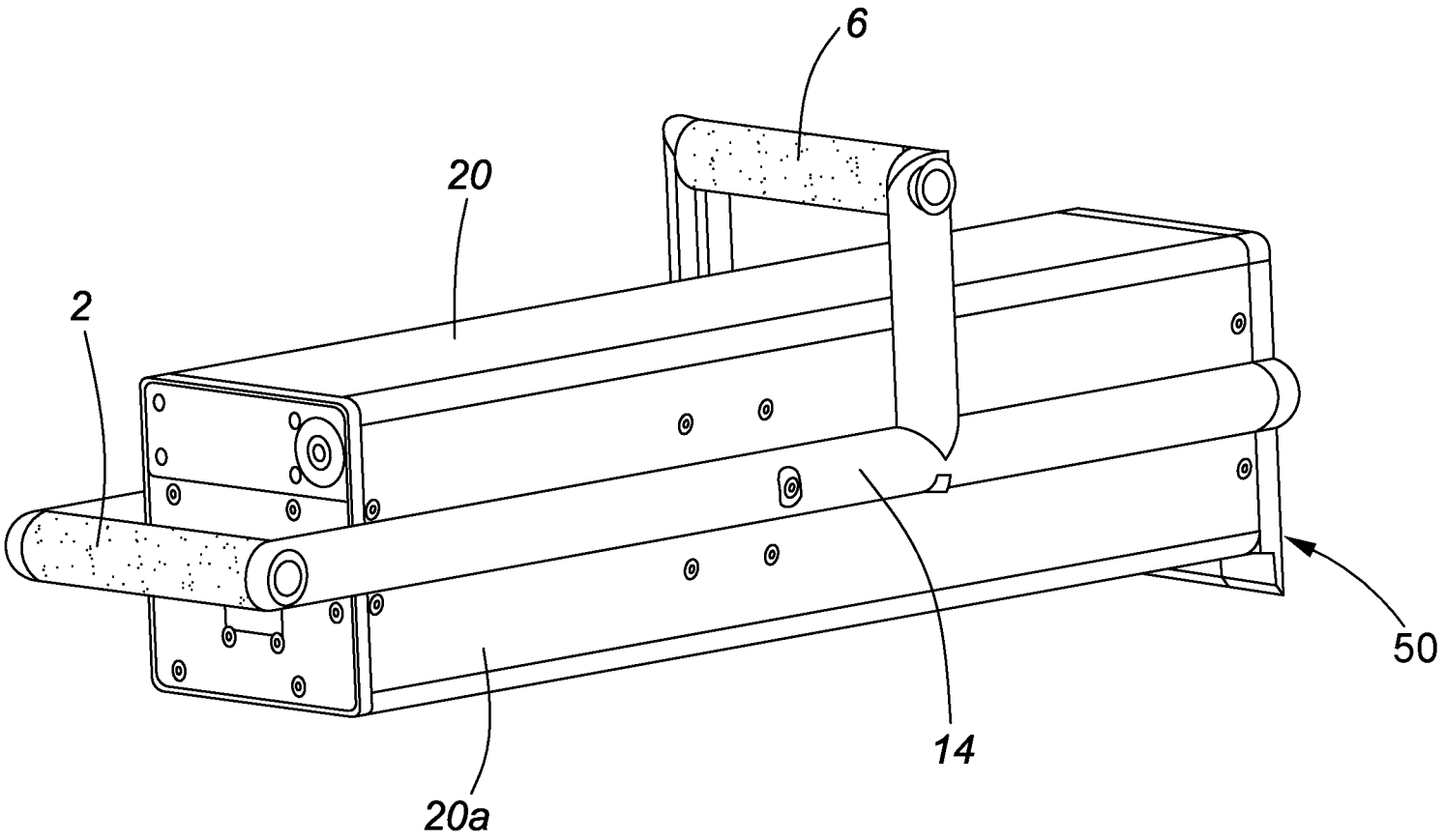
FIG. 5 is a side perspective view of the door breacher according to a preferred embodiment of the present invention.

FIG. 5 provides a perspective view of a preferred embodiment of the door breacher displaying the handles (2 and 6) in a desirable position should the door breacher be used as a battering ram. One handle (2) is located on the extremity of the device opposite that of the striking head (50) of the battering ram. This figure also provides a view of the external panels (20 and 20*a*) which are used to generally protect the internal components of the door breacher from the elements (such as dust, water, etc.). The panels (20 and 20*a*) may be made of any durable material, preferably the material should be lightweight not to add too much weight to the device to ensure it may be handled by most people. Fiberglass, aluminum, lightweight composites are just a few of the materials that can be considered for the manufacturing of the panels.

Figure 6:
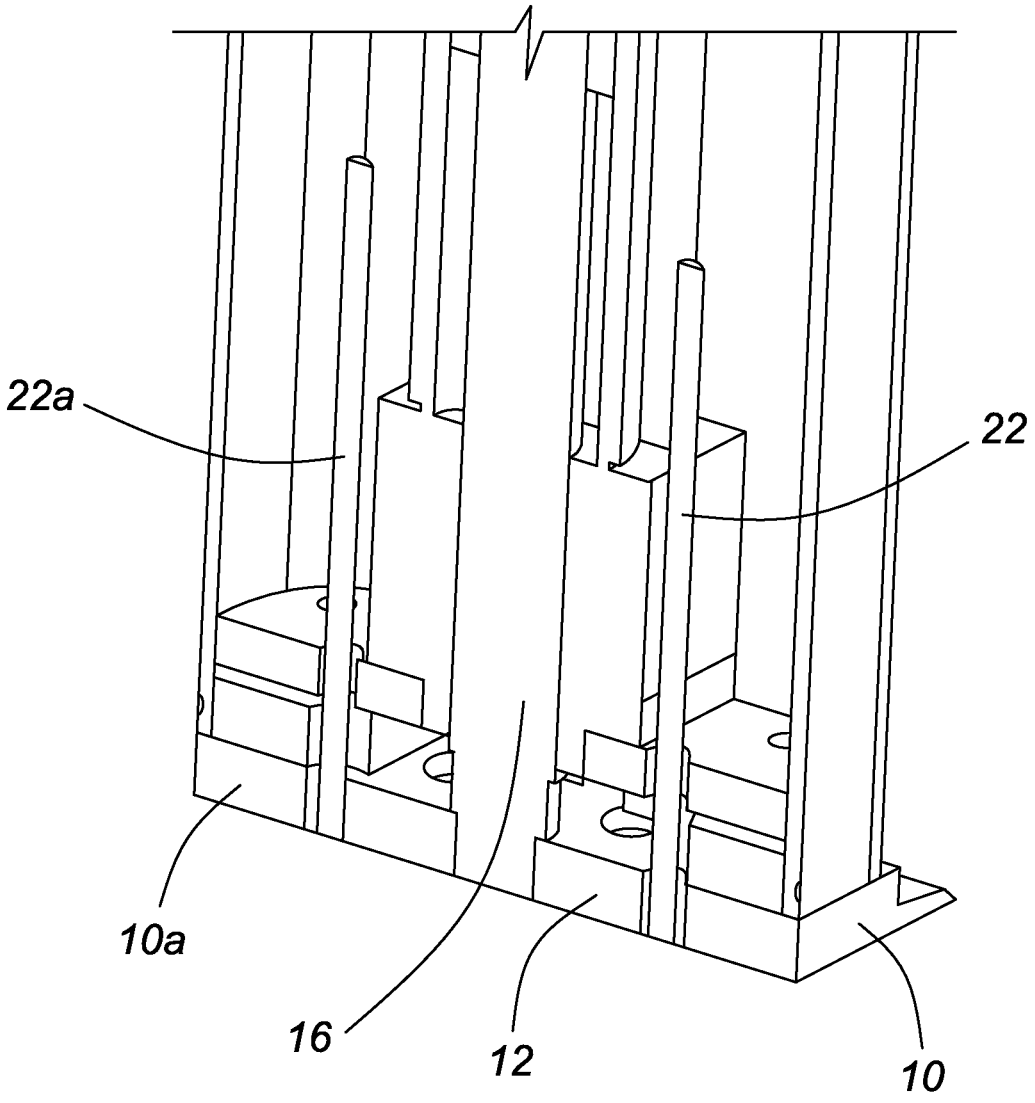
FIG. 6 is a cross-sectional close up view of the back of the jaw member in a retracted position of the door breacher according to a preferred embodiment of the present invention.
Figure 7:
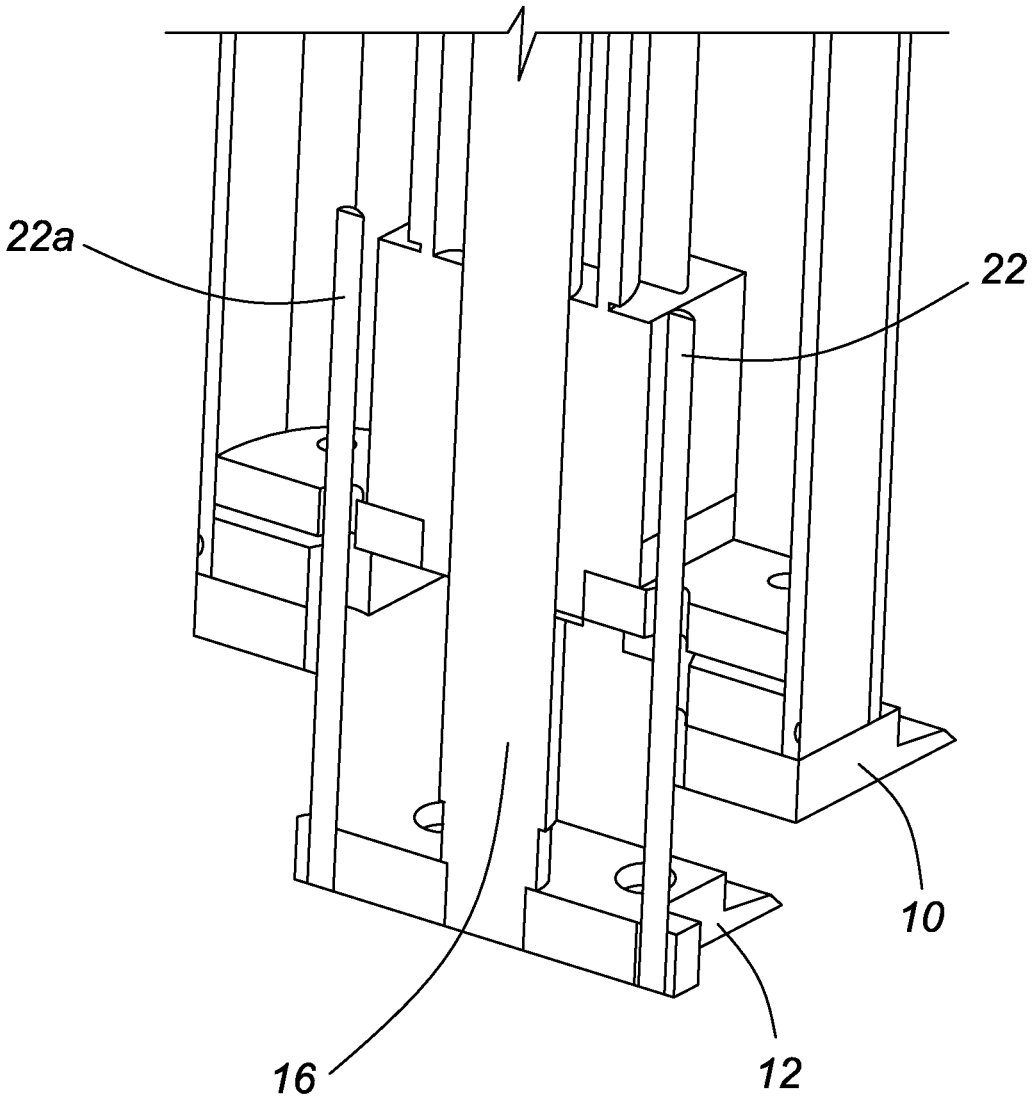
FIG. 7 is a cross-sectional close up view of the back of the jaw member in an extended position of the door breacher according to a preferred embodiment of the present invention.

FIG. 6 shows a cross-sectional back close up view of the jaw members (10, 10*a* and 12) in a "rest" position and the piston rod (16) adapted to push the movable jaw member (12) outwardly when the electrohydraulic system is activated as seen in FIG. 7. Elements (22 and 22*a*) are guide rods adapted to provide additional stability to the movable jaw (12) upon actuation.

Figure 8:
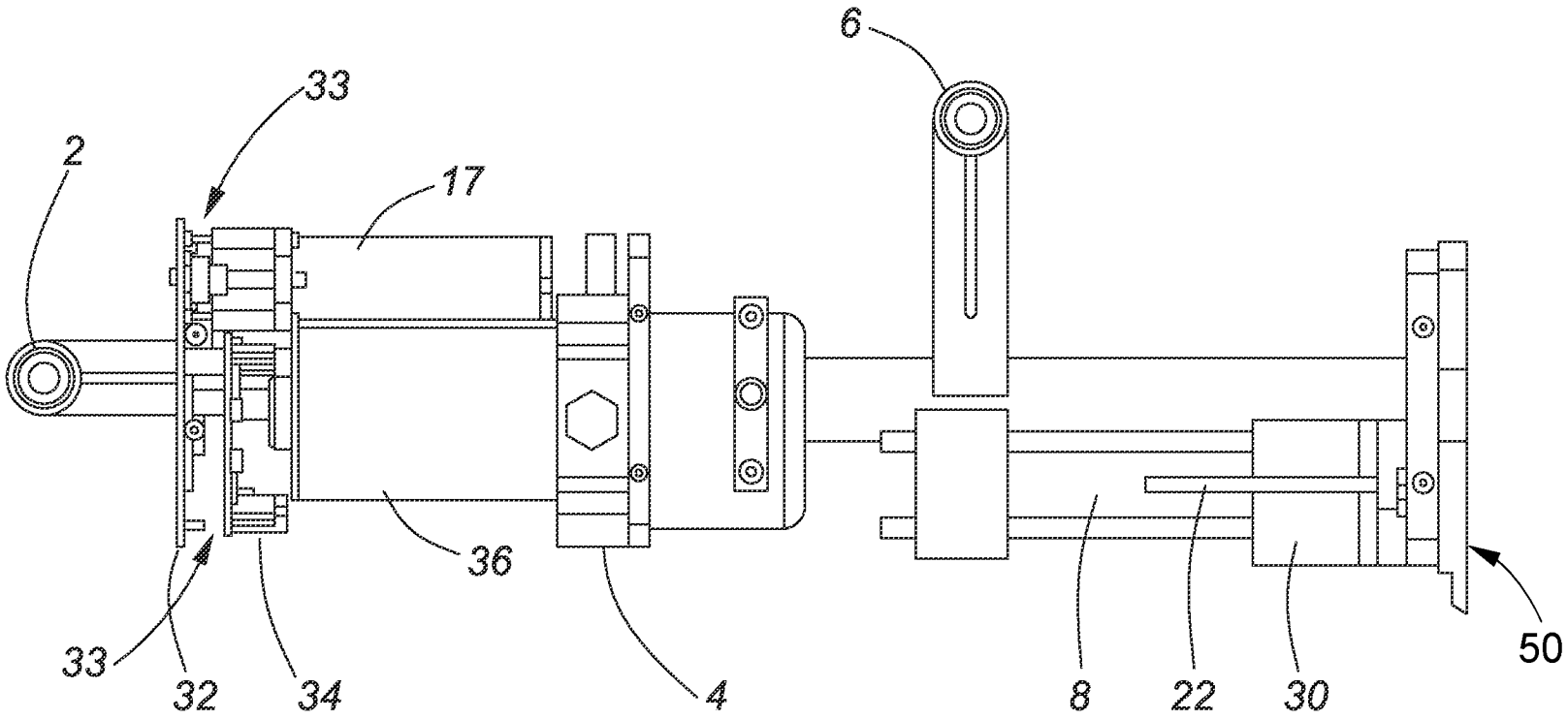
FIG. 8 is a cross-sectional side view of the door breacher according to a preferred embodiment of the present invention without any covering panels to show the various inner elements.

FIG. 8 shows a cross-sectional side view of a preferred embodiment of the door breacher with no panels covering the internal components and none of the longitudinal frame members. The door breacher has a motor (36) and a battery pack (17), which is also called a power dense electrical storage device. The motor (36) is operatively connected to the pump (4). The electronic regulation subsystem (33) is operatively connected to the main control unit (34). The radio communication board (32), which is an example of a wireless reception and transmission means, allows for remotely activating the door breacher. The main control unit (34) allows sending the signal to the motor (36), which then activates the pump and begins the fluid flow into the piston chamber to actuate the piston and begin extending the piston rod (16) outwardly and breach a door. The handles (2 and 6) are also in evidence. One handle (2) is located on the extremity of the device opposite that of the striking head (50).

Figure 9:
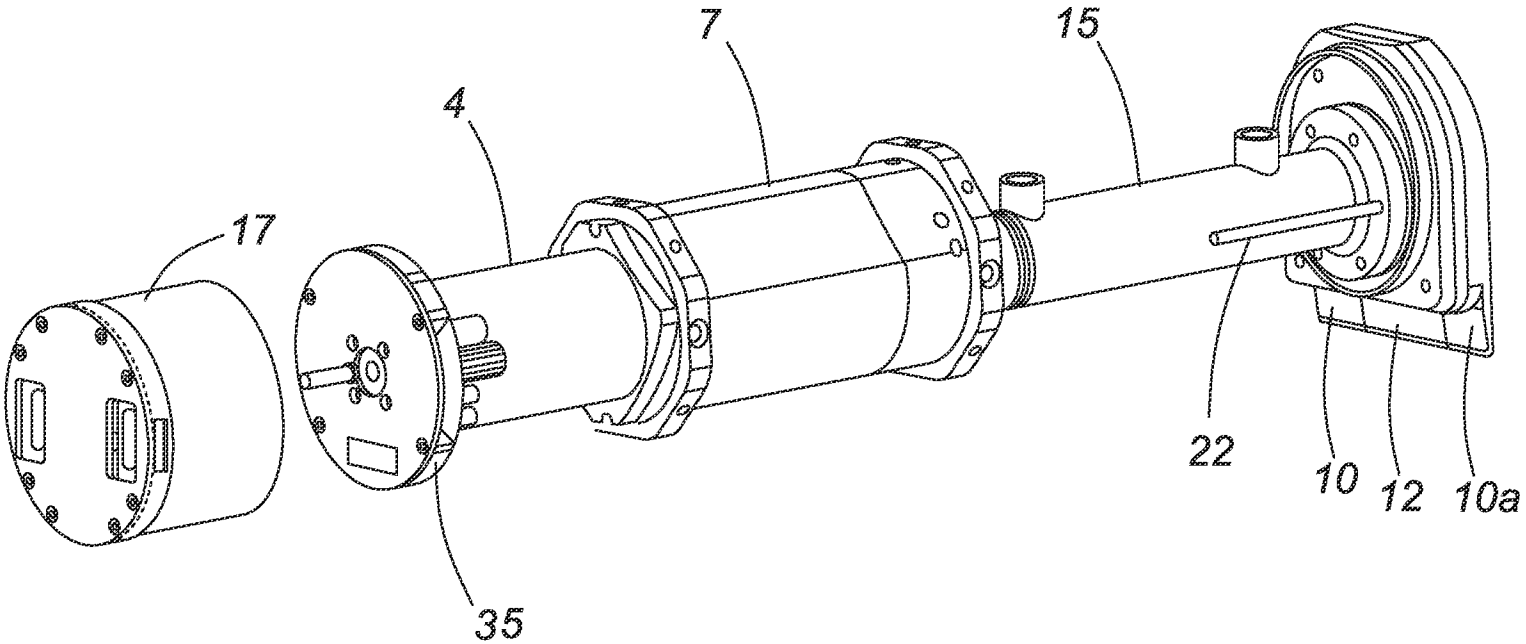
FIG. 9 is an exploded side perspective of the door breacher according to a preferred embodiment of the present invention.
Figure 10:
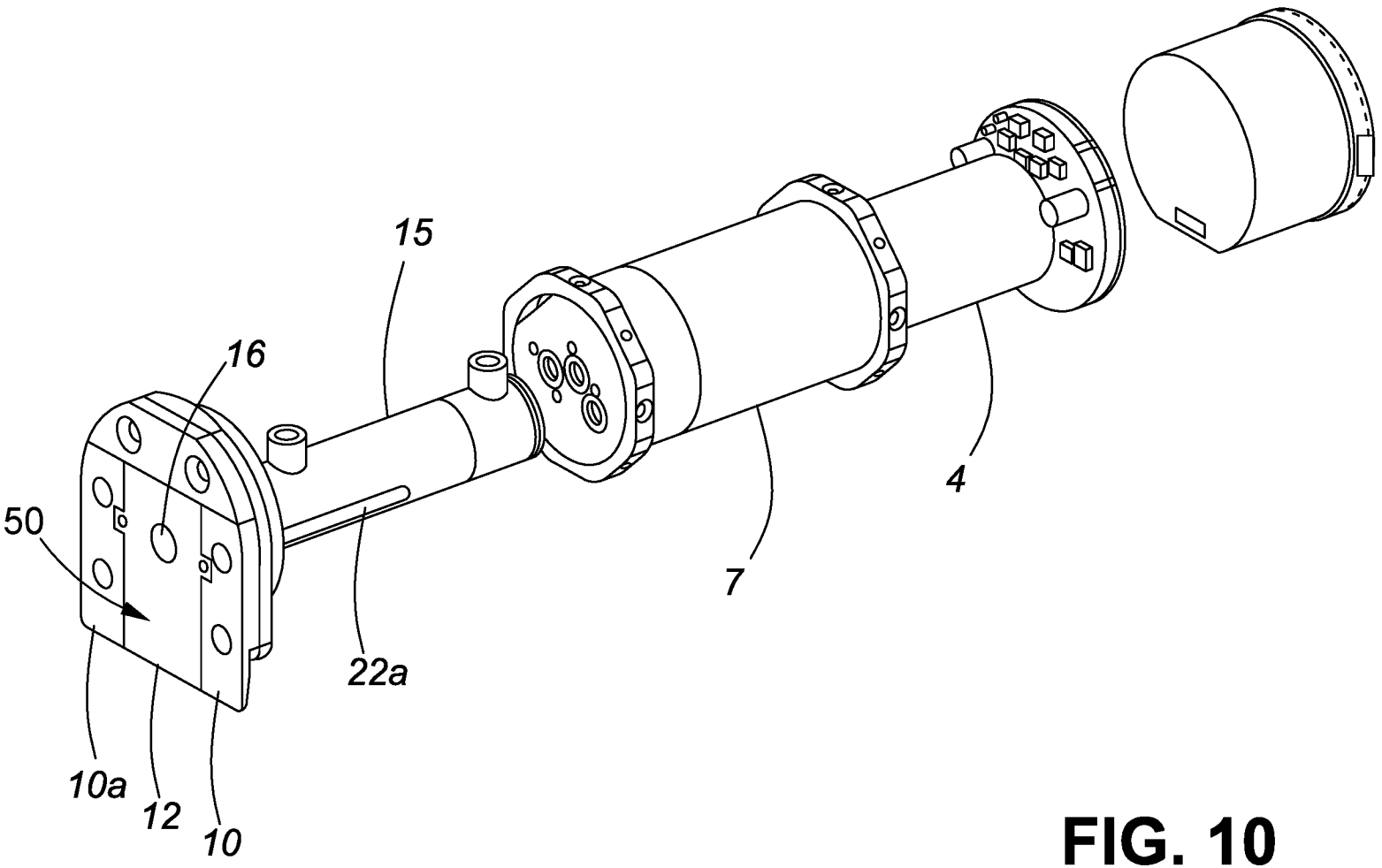
FIG. 10 is an exploded side perspective of the door breacher according to a preferred embodiment of the present invention.

FIGS. 9 and 10 illustrate two opposite exploded perspective views of the door breacher according to a different embodiment without the chassis or casing. The door breaching device depicted therein is designed to have a cylindrical casing (not shown) and a battery pack (17), which is also called a power dense electrical storage device. The guide rods (22 and 22*a*) are put in evidence as well as the jaw members (10, 10*a* and 12) in a retracted position, which form the striking head (50). Reference numeral 7 refers to the hydraulic pump and reservoir combined together according to this preferred embodiment. The door breacher has a main control board (35), which comprises an electronic regulation system, control unit, and wireless reception and transmission means.

Figure 11:
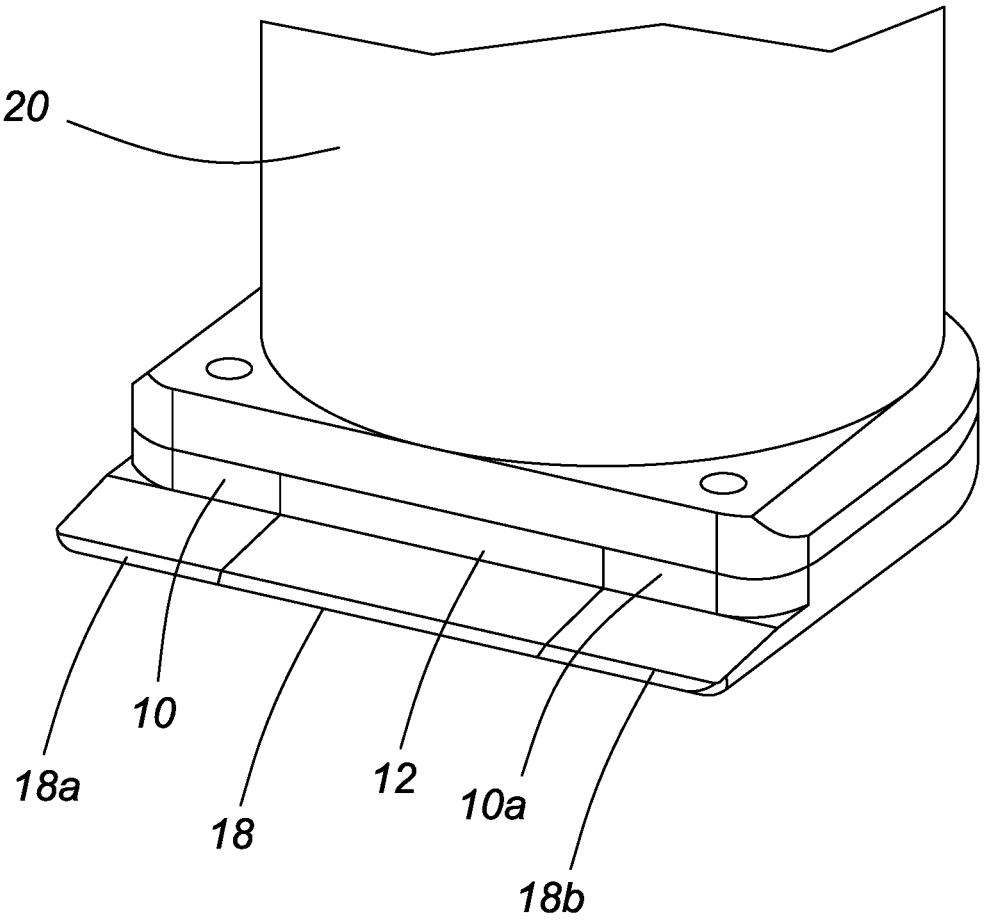
FIG. 11 is a close up perspective view of the jaw member in the retracted position of a door breacher according to a preferred embodiment of the present invention.

FIG. 11 is a close up of the jaw member (10, 10*a* and 12) of the door breacher illustrated in FIGS. 9 and 10. The multi-tapered edge of the teeth (18, 18*a* and 18*b*) are visible. These allow easier insertion in the space between a door and a door frame. The jaws of the door breacher are in a retracted position ready for insertion between a door and a door frame.

Figure 12:
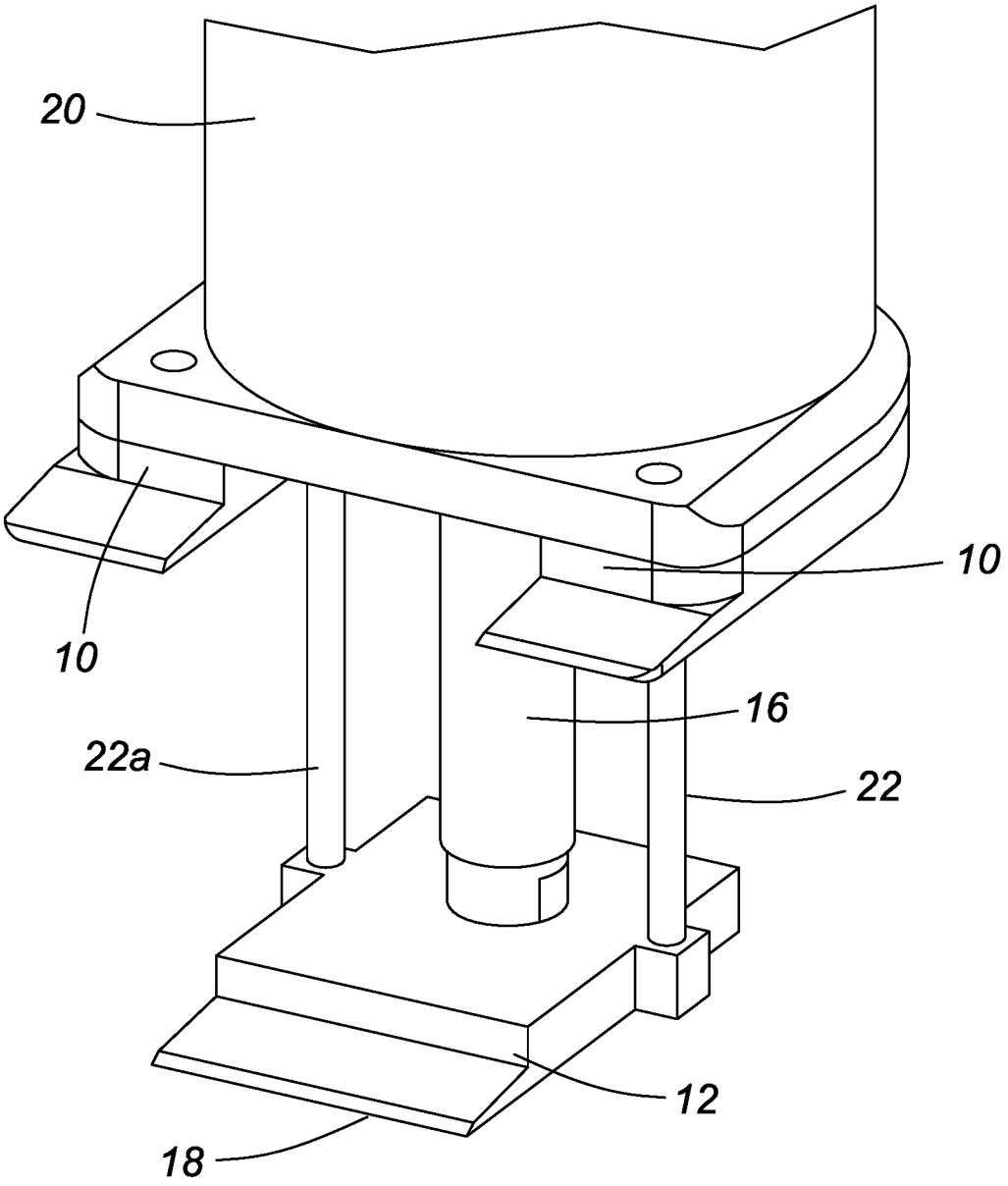
FIG. 12 is a close up perspective view of the jaw member in an extended position of a door breacher according to a preferred embodiment of the present invention.

FIG. 12 is a close up of the front of the door breacher device illustrated in FIGS. 9 and 10 more specifically focusing on the jaw member (10, 10*a* and 12) showing the jaws of the door breacher in an extended ("open") position after the piston rod (16) was actuated to move the movable jaw (12) outwardly away from the fixed jaws (10 and 10*a*).

Figure 13:
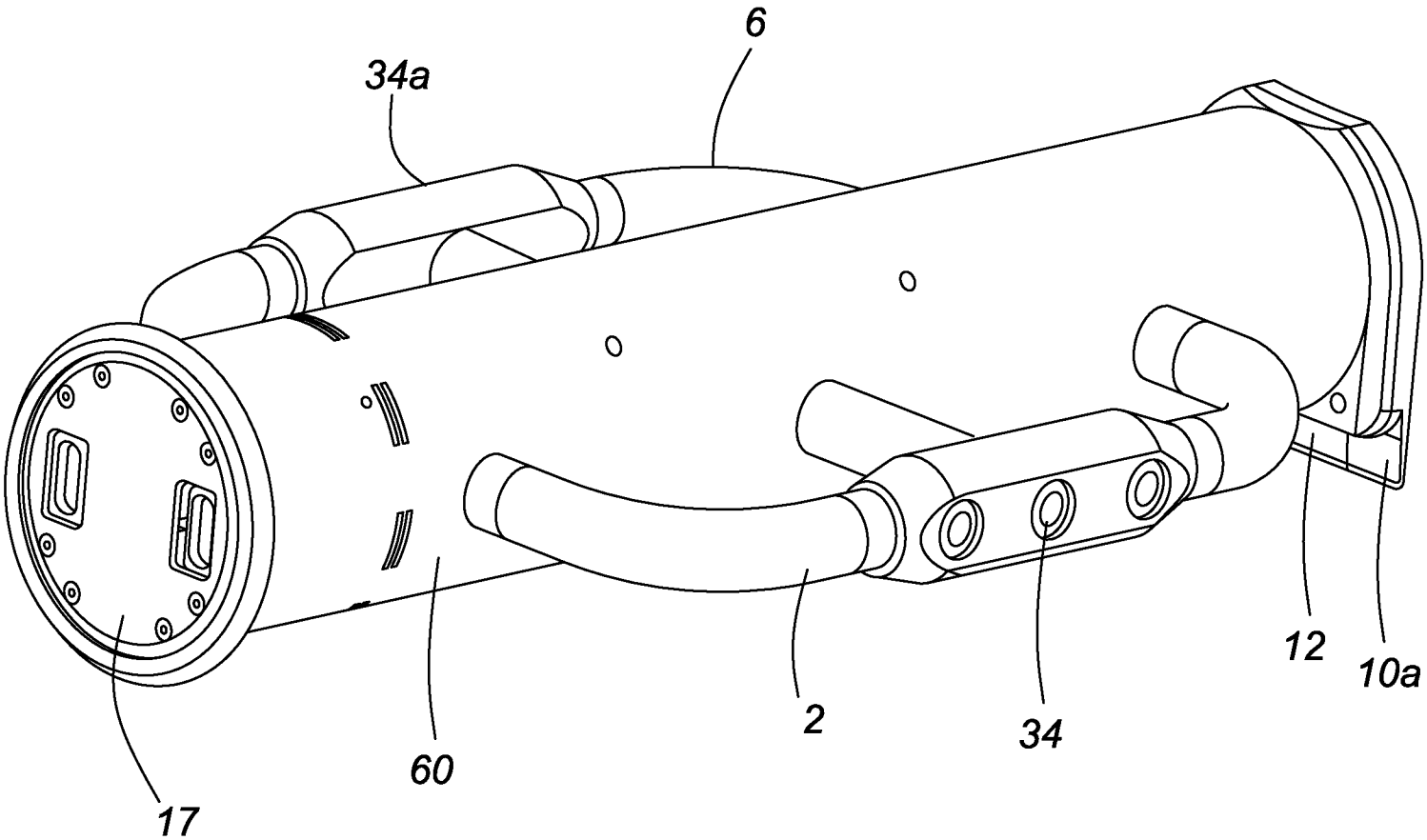
FIG. 13 is a side perspective view of the door breacher according to a preferred embodiment of the present invention.
Figure 14:
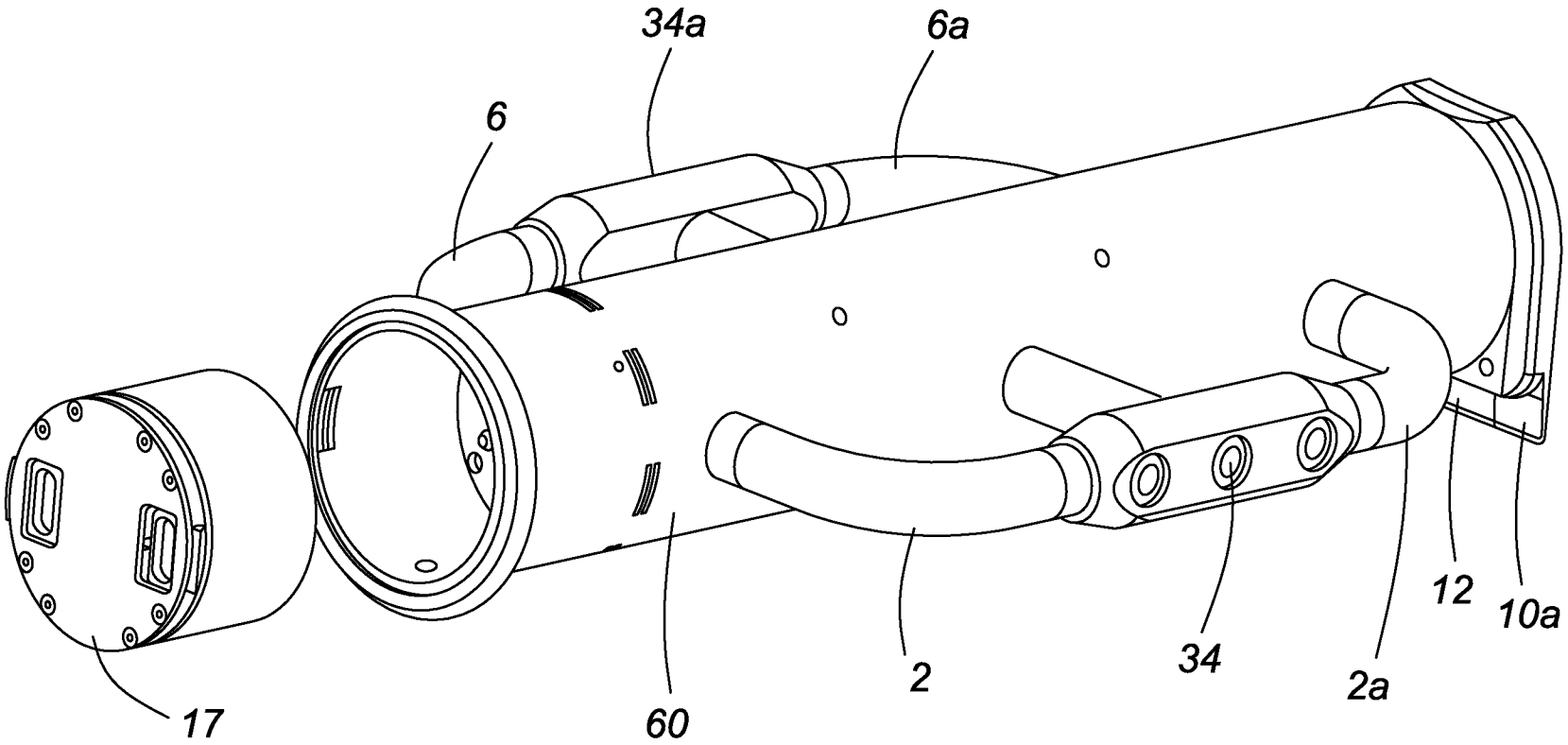
FIG. 14 is a side perspective view of the door breacher according to a preferred embodiment of the present invention.
Figure 15:
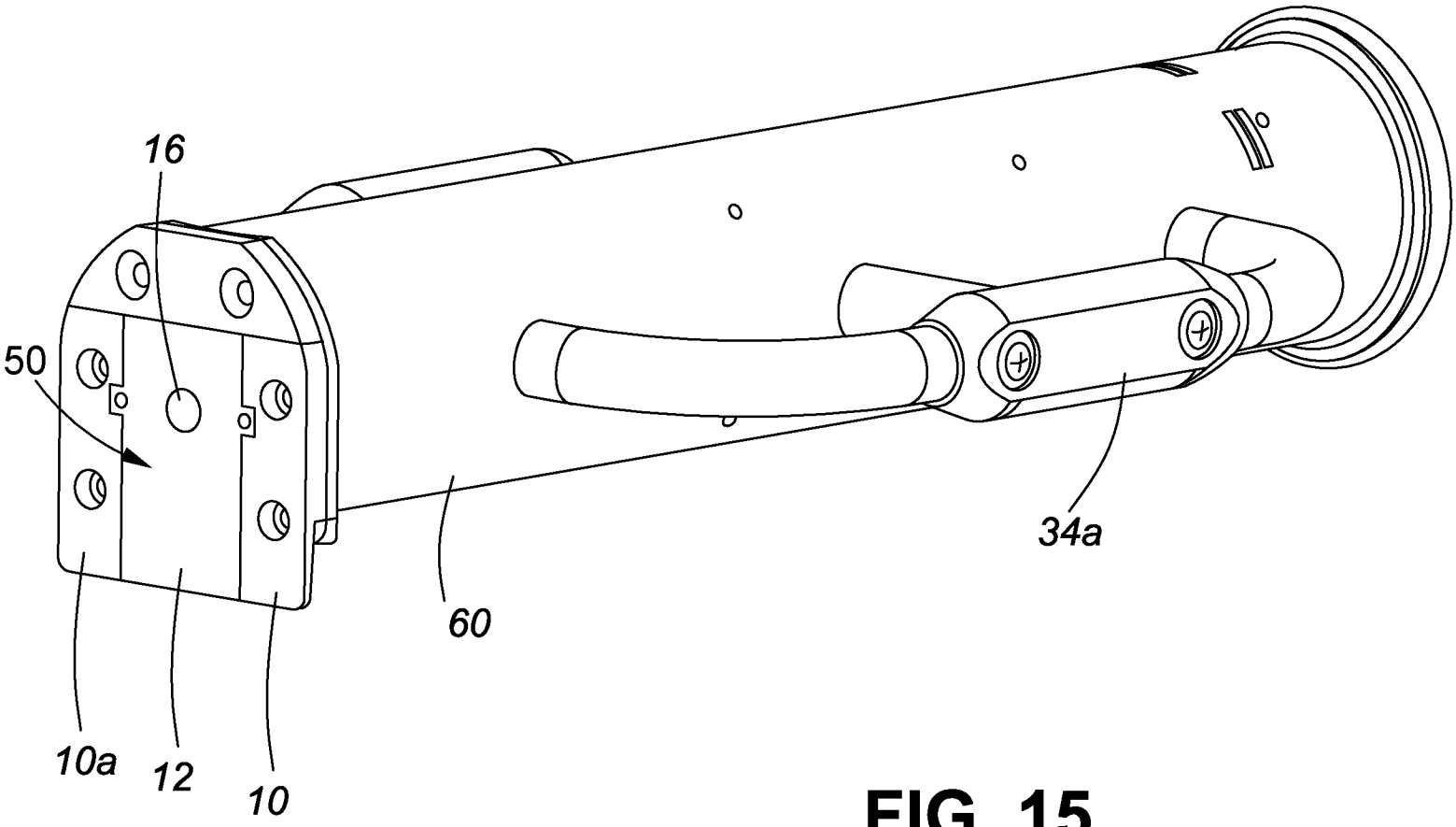
FIG. 15 is a side perspective view of the door breacher according to a preferred embodiment of the present invention.

FIGS. 13 and 15 illustrate opposite perspective views of the door breacher according to a preferred embodiment of the present invention. In this embodiment, the handles (2, 2*a* and 6, 6*a*) are on opposite sides of the longitudinal chassis (60). According to the embodiment illustrated in FIGS. 13, 14, 15 and 16, the door breacher may comprise two control units (34 and 34*a*) which can allow an operator to actuate operation of the door breacher from either side of the device (handle (2) or handle (6)). The piston chamber (15) is located proximate the first end of the longitudinal chassis (60) and comprises the piston rod (16). On either side of the piston chamber (15) are located guide rods (22 and 22*a*) which prevent rotation of the movable jaw (12) upon actuation. The striking head (50) is positioned on the first end of the longitudinal chassis (60) of the door breacher (1).

Figure 16:
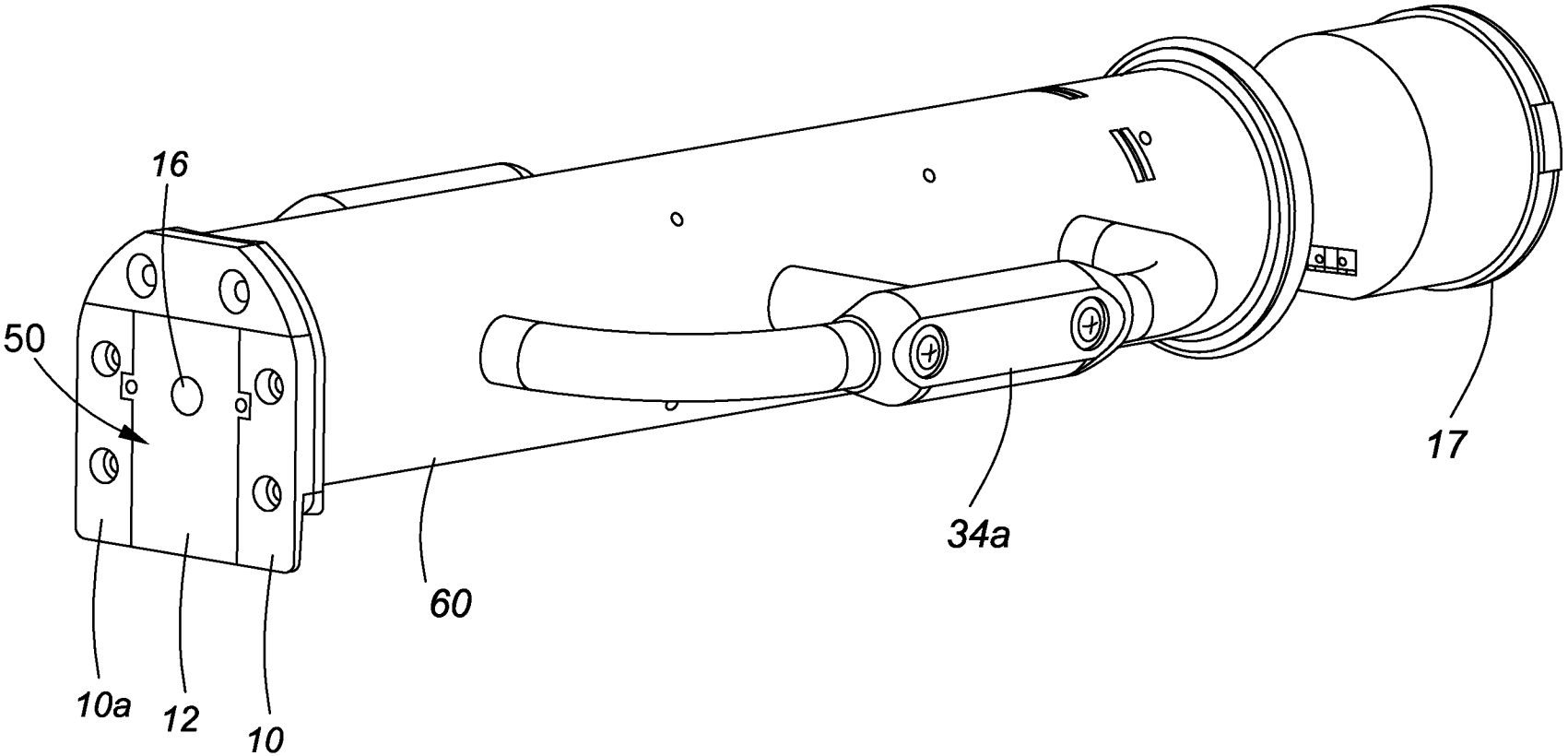
FIG. 16 is a side perspective view of the door breacher according to a preferred embodiment of the present invention.
Figure 17:
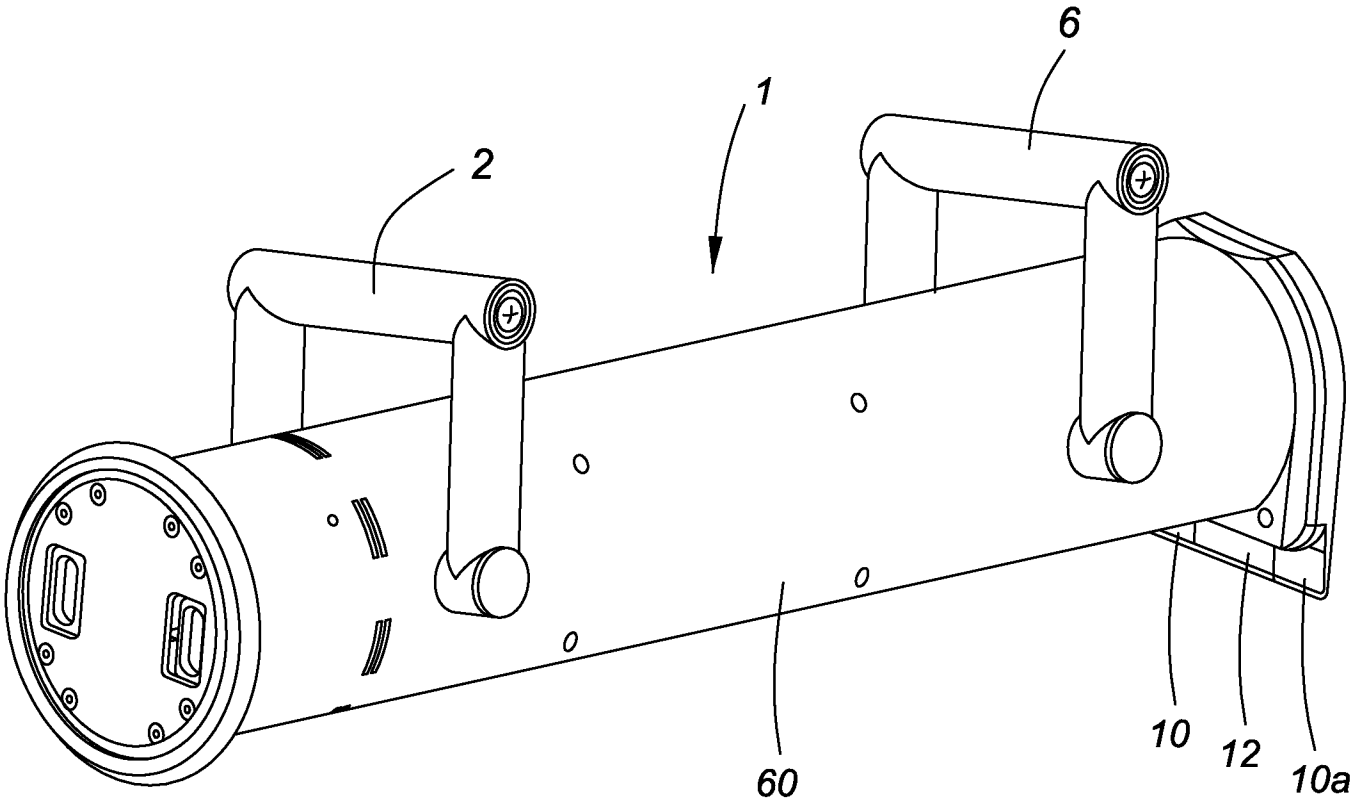
FIG. 17 is a side perspective view of the door breacher according to a preferred embodiment of the present invention.
Figure 18:
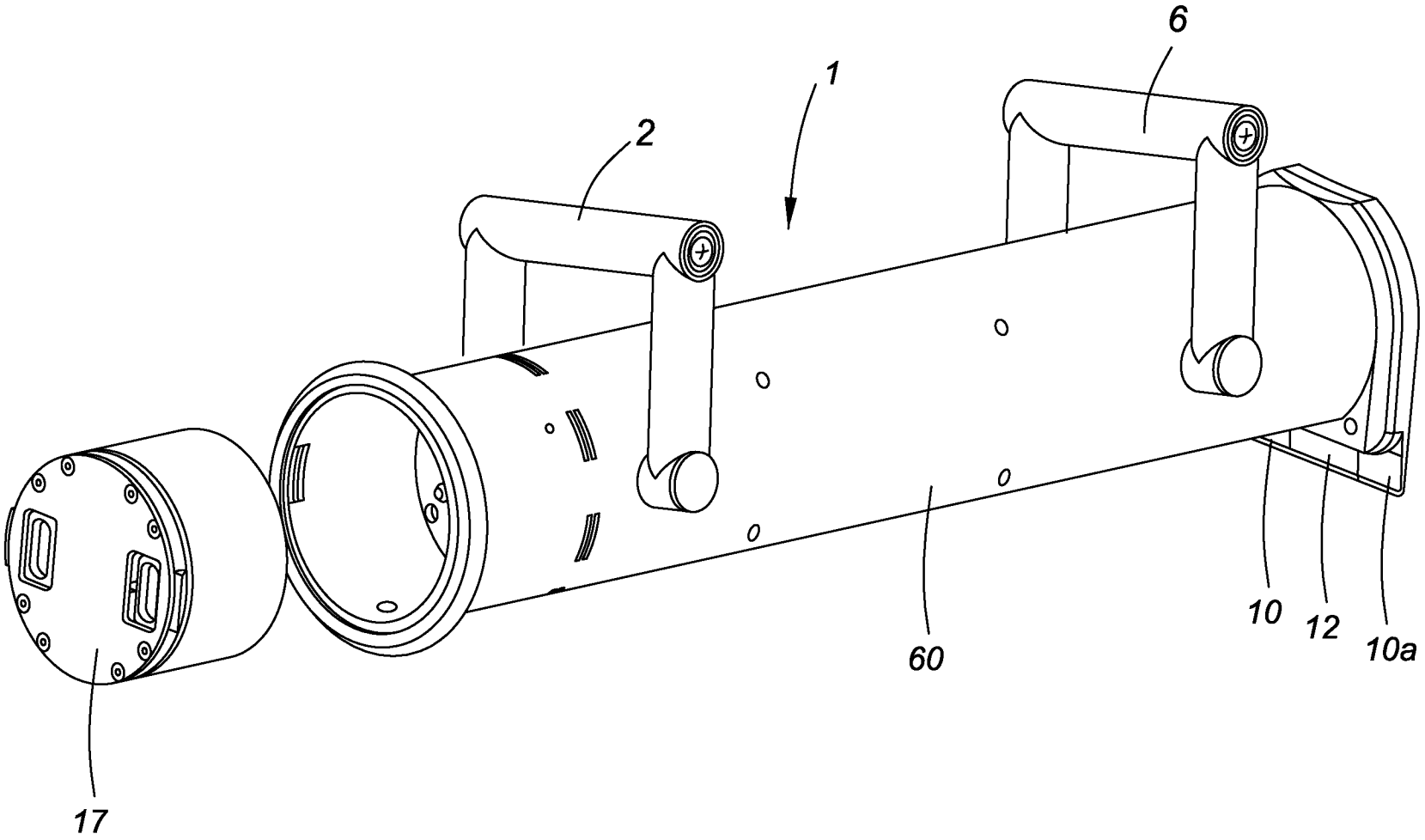
FIG. 18 is a side perspective view of the door breacher according to a preferred embodiment of the present invention.
Figure 19:
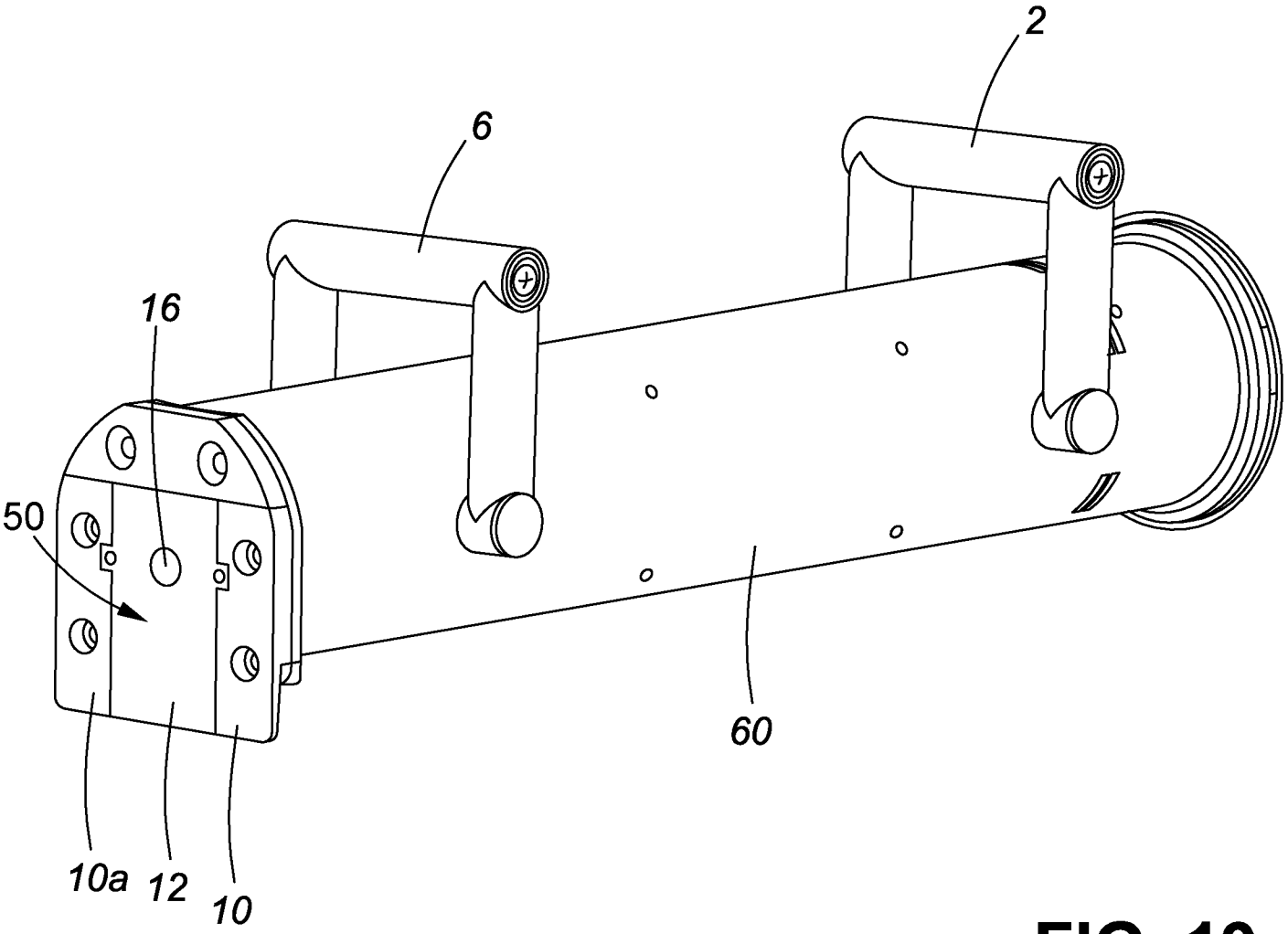
FIG. 19 is a side perspective view of the door breacher according to a preferred embodiment of the present invention.
Figure 20:
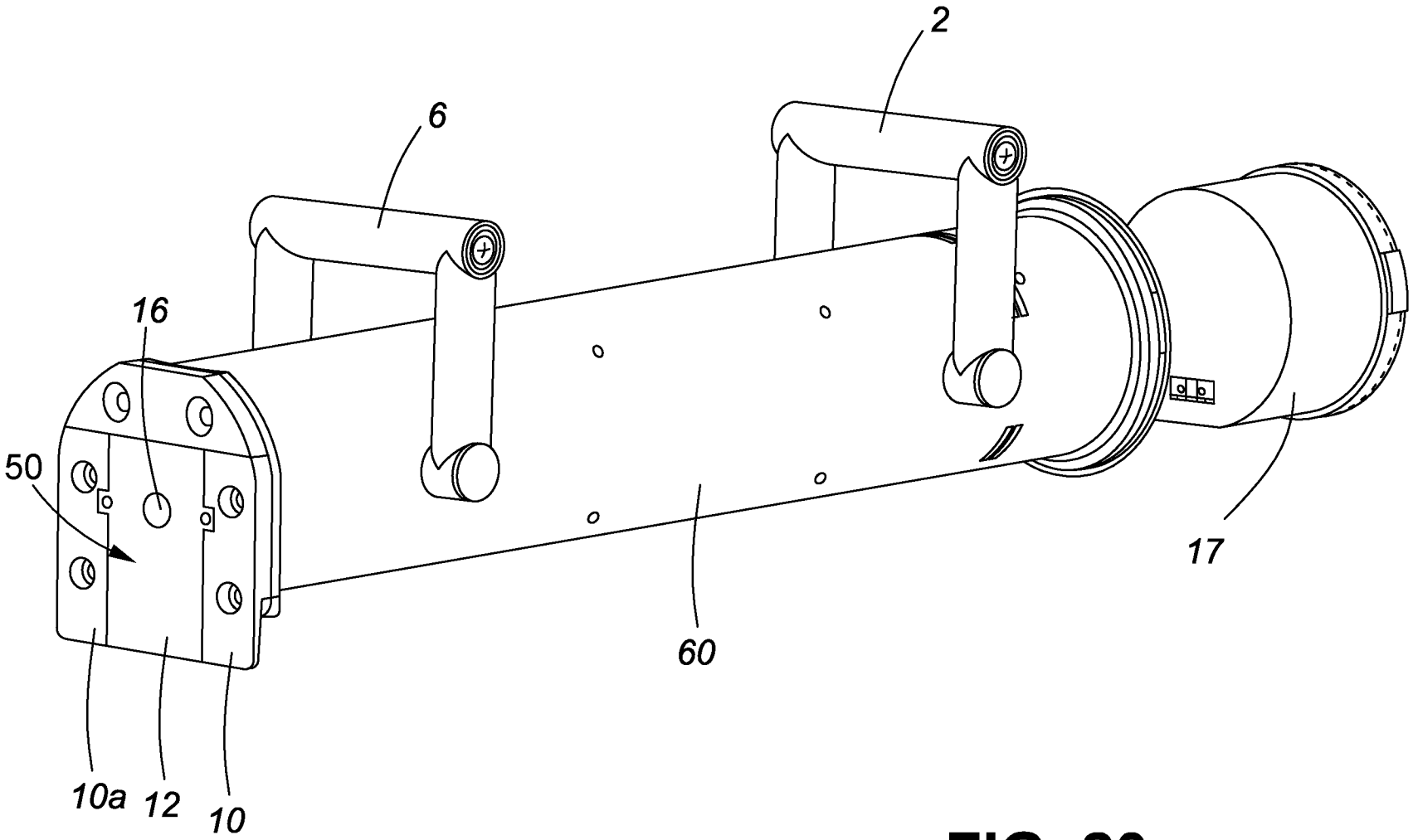
FIG. 20 is a side perspective view of the door breacher according to a preferred embodiment of the present invention.

FIGS. 14 and 16 illustrate opposite perspective views of the door breacher according to a preferred embodiment of the present invention. These figures illustrate the door breacher with the battery pack (17) removed from inside the chassis. The battery pack (also called a power dense electrical storage device) provides power to the motor and control panel/control unit (34).

Similarly, FIGS. 17 and 19 and FIGS. 18 and 20 provide complimentary perspective views of yet another preferred embodiment of the present invention. In this illustrated embodiment, the handles (2 and 6) are located on the same side of the longitudinal chassis (60) of the door breacher (1). The striking head (50) is positioned on one end of the longitudinal chassis (60) of the door breacher (1).

While preferred embodiments of the present invention have been illustrated in detail, it is apparent that modifications and adaptations of the preferred embodiment will occur to those skilled in the art. However, it is to be expressly understood that such modifications and adaptations are in the spirit and scope of the present invention as set forth in the following claims.

The invention claimed is:

1. A door breaching device comprising:

a longitudinal chassis having a first extremity and a second extremity opposite the first extremity;

a piston assembly, the piston assembly comprising a piston rod and a piston chamber, the piston rod adapted for linear displacement within the piston chamber;

a motor operatively connected to a hydraulic pump, the hydraulic pump being operatively connected to the piston assembly;

a control unit for user input, the control unit being operatively connected to the motor;

a two-part head assembly comprising:

a fixed jaw attached to the first extremity of the longitudinal chassis; and a moveable jaw operatively connected to an end of the piston rod proximate to the first extremity, wherein, when the device is in a rest position, the piston rod is in a retracted position within the piston chamber to allow a portion of the fixed jaw and a portion of the moveable jaw to fit between a first surface and a second surface, wherein the movable jaw and the fixed jaw each have a first extremity having a tapered end and adapted for insertion between the first surface and the second surface, and a second extremity opposite the first extremity, and wherein, upon actuation of the device, the piston rod is linearly displaced from the retracted position to an extended position thereby having an outer surface of the moveable jaw be out of alignment with and not in a same plane as an outer surface of the fixed jaw, the moveable jaw braces the device against the first surface and the fixed jaw braces the device against the second surface, and the movable jaw applies a force to increase a distance between the first surface and the second surface.

2. The door breaching device of claim 1, wherein the fixed jaw and the moveable jaw form an L-shaped extension with the longitudinal chassis when the device is in the rest position, wherein the fixed jaw and the moveable jaw form an F-shaped extension with the longitudinal chassis when the device is actuated.

3. The door breaching device of claim 1, further comprising at least one guide rod substantially parallel to the piston.

4. The door breaching device of claim 3, wherein the at least one guide rod is secured proximate the second extremity of the movable jaw and the piston rod is secured proximate the first extremity of the movable jaw.

5. The door breaching device of claim 1, further comprising an electronic regulation subsystem operatively connected to the control unit.

6. The door breaching device of claim 5, further comprising a power dense electrical storage device operatively connected to the motor and the control unit.

7. The door breaching device of claim 1, further comprising a primary state control subsystem adapted to interpret the user input and a current state of the device in order to assist a user in determining the correct mode of operation for the device and the appropriate motor movement status.

8. A door breaching device comprising:

a longitudinal chassis having a first extremity and a second extremity opposite the first extremity;

a piston assembly, the piston assembly comprising a piston rod and a piston chamber, the piston rod adapted for linear displacement within the piston chamber;

a hydraulic pump operatively connected to the piston assembly;

a control unit for user input, the control unit being operatively connected to the hydraulic pump;

a striking head including a two-part head assembly, the two-part head assembly comprising:

a fixed jaw attached to the first extremity of the longitudinal chassis; and a moveable jaw operatively connected to an end of the piston rod proximate to the first extremity, wherein a substantially flat outer surface of the striking head is positioned substantially perpendicular to a longitudinal axis of the longitudinal chassis when the door breaching device is in a rest position, wherein, when the door breaching device is in the rest position, the piston rod is in a retracted position within the piston chamber to allow a portion of the fixed jaw and a portion of the moveable jaw to fit between a first surface and a second surface, and an outer surface of the moveable jaw is in alignment with and in a same plane as an outer surface of the fixed jaw to form the substantially flat outer surface of the striking head, wherein the movable jaw and the fixed jaw each have a first extremity having a tapered end and adapted for insertion between the first surface and the second surface, and a second extremity opposite the first extremity, and wherein, upon actuation of the door breaching device, the piston rod is linearly displaced from the retracted position to an extended position thereby having the outer surface of the moveable jaw be out of alignment with and not in the same plane as the outer surface of the fixed jaw, the moveable jaw braces the device against the first surface and the fixed jaw braces the device against the second surface, and the movable jaw applies a force to increase a distance between the first surface and the second surface.

9. The door breaching device of claim 8, wherein the fixed jaw and the moveable jaw form an L-shaped extension with the longitudinal chassis when the device is in the rest position, wherein the fixed jaw and the moveable jaw form an F-shaped extension with the longitudinal chassis when the device is actuated.

10. The door breaching device of claim 8, further comprising at least one guide rod substantially parallel to the piston.

11. The door breaching device of claim 10, the at least one guide rod comprising:

a first guide rod having a first guide rod end and a second guide rod end opposite the first guide rod end, said first guide rod positioned on one side of the piston rod and parallel to the piston rod, said first guide rod end attached to the movable jaw and the second guide rod end slidably engaged with the chassis, wherein a diameter of the first guide rod is smaller than a diameter of the piston rod; and a second guide rod having a first rod end and a second rod end opposite the first rod end, said second guide rod positioned on an opposite side of the piston rod and parallel to the piston rod, said first rod end attached to the movable jaw and the second rod end slidably engaged with the chassis, wherein a diameter of the second guide rod is smaller than the diameter of the piston rod, wherein the first and second guide rods are spaced apart a distance greater than the diameter of the piston rod.

12. The door breaching device of claim 8, further comprising an electronic regulation subsystem operatively connected to the control unit.

13. The door breaching device of claim 12, further comprising a power dense electrical storage device operatively connected to the hydraulic pump and the control unit.

14. The door breaching device of claim 8, further comprising a primary state control subsystem adapted to interpret the user input and a current state of the door breaching device in order to assist a user in determining the correct mode of operation for the device and the appropriate hydraulic movement status.

15. The door breaching device of claim 8, further comprising a motor operatively connected to the hydraulic pump, the motor being operatively connected to the piston assembly.

16. A door breaching device comprising:

a longitudinal chassis having a first extremity and a second extremity opposite the first extremity;

a piston assembly, the piston assembly comprising a piston rod and a piston chamber, the piston rod adapted for linear displacement within the piston chamber;

a motor operatively connected to a hydraulic pump, the hydraulic pump being operatively connected to the piston assembly;

a control unit for user input, the control unit being operatively connected to the motor;

a striking head including a two-part head assembly, the two-part head assembly comprising:

a fixed jaw attached to the first extremity of the longitudinal chassis; and a moveable jaw operatively connected to an end of the piston rod proximate to the first extremity, wherein a substantially flat outer surface of the striking head is positioned substantially perpendicular to a longitudinal axis of the longitudinal chassis when the door breaching device is in a rest position, wherein, when the door breaching device is in the rest position, the piston rod is in a retracted position within the piston chamber to allow a portion of the fixed jaw and a portion of the moveable jaw to fit between a first surface and a second surface, and an outer surface of the moveable jaw is in alignment with and in a same plane as an outer surface of the fixed jaw to form the substantially flat outer surface of the striking head, and wherein, upon actuation of the door breaching device, the piston rod is linearly displaced from the retracted position to an extended position thereby having the outer surface of the moveable jaw be out of alignment and not in the same plane with the outer surface of the fixed jaw, the moveable jaw braces the device against the first surface and the fixed jaw braces the device against the second surface, and the movable jaw applies a force to increase a distance between the first surface and the second surface, wherein the fixed jaw and the moveable jaw form an L-shaped extension with the longitudinal chassis when the device is in the rest position, wherein the fixed jaw and the moveable jaw form an F-shaped extension with the longitudinal chassis when the device is actuated.

17. The door breaching device of claim 16, wherein the longitudinal chassis includes two locations where a user holds onto the device.

18. The door breaching device of claim 17, wherein a location of the two locations is positioned at the second extremity of the longitudinal chassis, wherein the device includes a handle positioned at the second extremity.

* * * * *